US010731401B2

(12) United States Patent
Summy

(10) Patent No.: US 10,731,401 B2
(45) Date of Patent: Aug. 4, 2020

(54) SILL PAN ASSEMBLY FOR POCKET DOOR SYSTEMS AND METHOD OF INSTALLATION

(71) Applicant: Gene Summy, Laguna Niguel, CA (US)

(72) Inventor: Gene Summy, Laguna Niguel, CA (US)

( * ) Notice: Subject to any disclaimer, the term of this patent is extended or adjusted under 35 U.S.C. 154(b) by 0 days.

(21) Appl. No.: 16/357,056

(22) Filed: Mar. 18, 2019

(65) Prior Publication Data

US 2020/0095822 A1 Mar. 26, 2020

Related U.S. Application Data

(62) Division of application No. 16/137,479, filed on Sep. 20, 2018, now Pat. No. 10,273,741.

(51) Int. Cl.
*E06B 1/70* (2006.01)
*E06B 3/46* (2006.01)

(52) U.S. Cl.
CPC ..... *E06B 1/70* (2013.01); *E06B 3/4654* (2013.01)

(58) Field of Classification Search
CPC ..... E06B 1/70; E06B 3/4654
USPC ..... 52/210
See application file for complete search history.

(56) References Cited

U.S. PATENT DOCUMENTS 993,861 A 5/1911 McRonald
1,677,160 A 7/1928 Woolfenden
1,950,519 A 3/1934 Ripley
2,043,049 A * 6/1936 Ludden ..... E04B 1/644 52/62
2,648,107 A 11/1960 Bates, Jr.
2,962,405 A 11/1960 Morthland
3,238,679 A 3/1966 Capoccia
3,451,178 A 6/1969 Beale
3,698,142 A 10/1972 Theriault
4,126,975 A 11/1978 Williams
4,248,926 A 2/1981 Tajima et al.
(Continued)

FOREIGN PATENT DOCUMENTS

CA 2473477 A1 * 1/2005 ..... B29C 67/0011
CA 2530690 A1 * 10/2006 ..... E06B 1/70
(Continued)

OTHER PUBLICATIONS

Forti Flash; Fortifiber Building Products Systems; Websites at www.fortifiber.com.

(Continued)

*Primary Examiner* — Jeanette E Chapman
(74) *Attorney, Agent, or Firm* — Knobbe, Martens, Olson & Bear LLP

(57) ABSTRACT

Multi-piece, flexible, sill pan assemblies and methods of installation are disclosed. Method of installation of a sill pan assembly for pocket door systems such as single- and double-door versions as well as multi-panel pocket doors. The sill pan assembly has a first flexible end dam member, a second flexible end dam member, a flexible outside corner member, and a flexible insert. Methods of installation of a sill pan assembly for a double-pocket door. The sill pan assembly having a first flexible end dam member, a second flexible end dam member, a first flexible outside corner member, a second flexible outside corner member, and a flexible insert.

20 Claims, 20 Drawing Sheets

(56) References Cited

U.S. PATENT DOCUMENTS

| | | | | |
|---|---|---|---|---|
| 4,555,882 | A | 12/1985 | Moffitt et al. | |
| 4,700,512 | A | 10/1987 | Laska | |
| 4,775,567 | A | 10/1988 | Harkness | |
| 4,872,296 | A | 10/1989 | Janni | |
| 5,077,943 | A | 1/1992 | McGady | |
| 5,109,641 | A | 5/1992 | Halan | |
| 5,218,793 | A | 6/1993 | Ball | |
| 5,255,481 | A | 10/1993 | Misera et al. | |
| 5,303,522 | A | 4/1994 | Vagedes | |
| 5,414,964 | A | 5/1995 | Bodycomb | |
| 5,586,415 | A | 12/1996 | Fisher et al. | |
| 5,706,610 | A | 1/1998 | Mayle | |
| 5,815,986 | A | 10/1998 | Laska | |
| 5,913,779 | A | 6/1999 | Edvardsen | |
| 5,927,039 | A | 7/1999 | De Boer | |
| 6,035,582 | A | 3/2000 | Pacific | |
| 6,070,370 | A | 6/2000 | Locke | |
| 6,098,343 | A | 8/2000 | Brown et al. | |
| 6,119,416 | A | 9/2000 | Larson | |
| 6,122,874 | A | 9/2000 | Smerilli | |
| 6,122,887 | A | 9/2000 | Massett et al. | |
| 6,256,956 | B1 | 7/2001 | Davis | |
| 6,327,820 | B1 | 12/2001 | Picco | |
| 6,401,401 | B1 | 6/2002 | Williams | |
| 6,401,402 | B1 * | 6/2002 | Williams | E06B 1/62 49/471 |
| 7,222,462 | B2 | 5/2007 | Ellingson | |
| 7,451,571 | B2 | 11/2008 | Ross | |
| 7,673,426 | B2 | 3/2010 | Broad | |
| 7,676,996 | B2 | 3/2010 | Teodorovich | |
| 7,735,291 | B2 | 6/2010 | Summy | |
| 7,775,004 | B2 | 8/2010 | Allen | |
| 7,877,940 | B2 | 2/2011 | Meeks | |
| 7,877,945 | B2 | 2/2011 | Eggen | |
| 8,069,622 | B2 | 12/2011 | Mees | |
| 8,869,462 | B2 | 10/2014 | Baron | |
| 9,163,450 | B2 | 10/2015 | Messenger | |
| D748,826 | S | 2/2016 | Norwood | |
| 9,341,018 | B2 | 5/2016 | Helton | |
| 9,702,468 | B2 | 7/2017 | Newhouse | |
| 9,845,624 | B2 | 12/2017 | Heid | |
| 9,845,634 | B2 * | 12/2017 | Heid | E06B 1/70 |
| 9,909,353 | B2 * | 3/2018 | Hendricks | E06B 1/702 |
| 9,982,477 | B1 | 5/2018 | Glickman | |
| 10,024,097 | B1 | 7/2018 | Glickman | |
| 10,065,580 | B1 | 9/2018 | Newman | |
| 10,161,179 | B2 | 12/2018 | Norwood | |
| 10,273,741 | B1 * | 4/2019 | Summy | E06B 1/62 |
| 2001/0034984 | A1 | 11/2001 | Murphy et al. | |
| 2002/0050103 | A1 | 5/2002 | Ackerman, Jr. | |
| 2003/0056444 | A1 | 3/2003 | Ackerman, Jr. | |
| 2005/0217189 | A1 * | 10/2005 | Moffitt | E06B 1/70 52/209 |
| 2006/0260213 | A1 | 11/2006 | Williams | |
| 2007/0289226 | A1 | 12/2007 | Lokkart | |
| 2012/0032406 | A1 | 2/2012 | Ksiezoposki | |
| 2012/0144761 | A1 | 6/2012 | Teodorovich | |

FOREIGN PATENT DOCUMENTS

| | | | | |
|---|---|---|---|---|
| DE | 102005030462 | A1 * | 1/2007 | E06B 3/9632 |
| DE | 102016120279 | A1 * | 4/2018 | E06B 1/70 |

OTHER PUBLICATIONS

Future Flash, Window Waterproofing System; MFM Building Products Corp., 525 Orange Street, Coshocton, OH 43812; (740) 622-2645; (800) 882-7663.

* cited by examiner

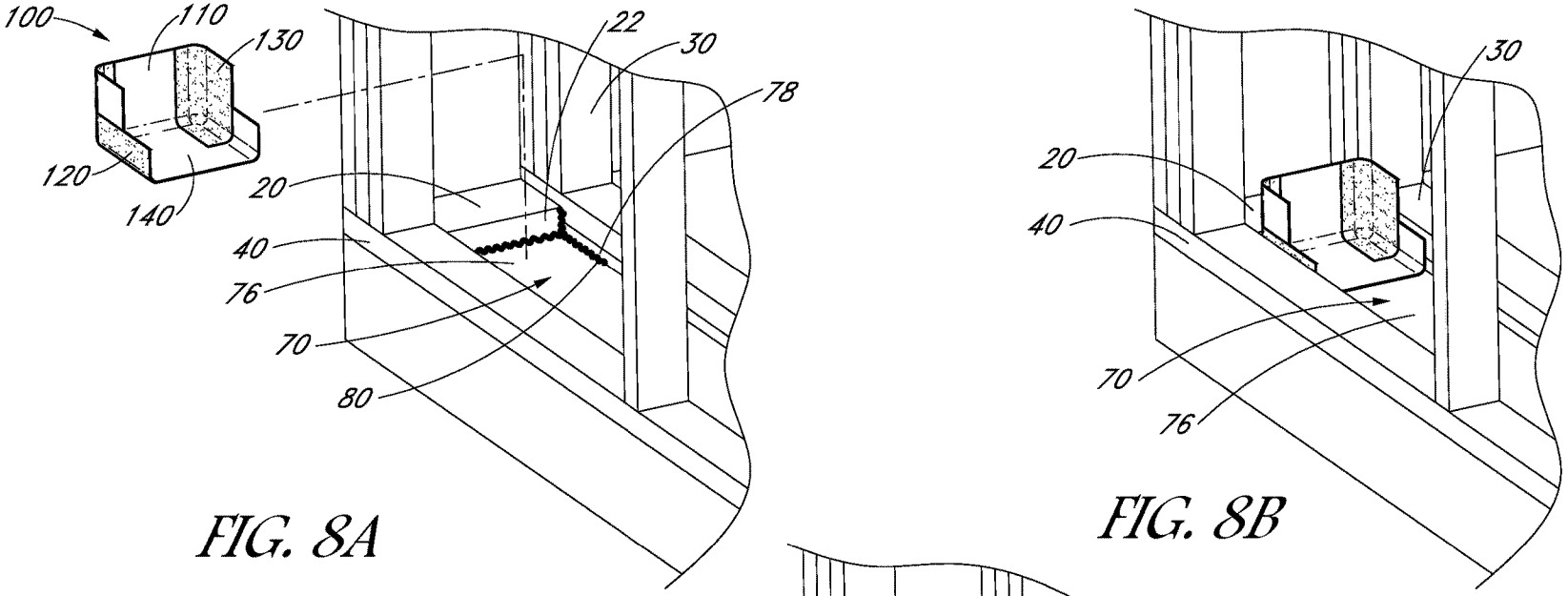
FIG. 8A
FIG. 8B
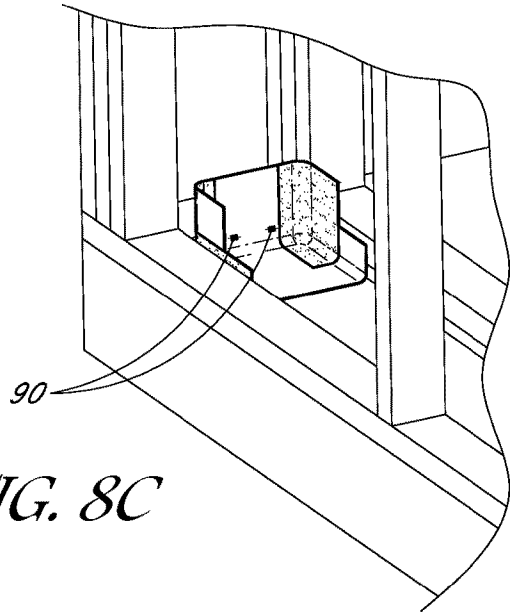
FIG. 8C

SILL PAN ASSEMBLY FOR POCKET DOOR SYSTEMS AND METHOD OF INSTALLATION

CROSS-REFERENCE TO RELATED APPLICATION

This application is a divisional application of U.S. patent application Ser. No. 16/137,479, filed Sep. 20, 2018, and entitled "SILL PAN ASSEMBLY FOR POCKET DOOR SYSTEMS AND METHOD OF INSTALLATION." The entire contents of the above application is hereby incorporated by reference and made a part of this specification. Any and all priority claims identified in the Application Data Sheet, or any correction thereto, are hereby incorporated by reference under 37 CFR § 1.57.

BACKGROUND

Field

Features for systems and methods of providing a sill pan for pocket door systems are described. More specifically, features for systems and methods for flashing and sealing around exterior pocket door systems such as single- and double-door versions as well as multi-panel pocket doors.

Description of the Related Art

Pocket doors are doors that include one or more panels that disappear into an opening inside the wall when opened. For single panel pocket doors, the panel slides into the opening when opened. Panels of a multi-panel pocket door stack in front of each other when slid into the opening inside the wall.

Pocket door systems also include double-door versions. Double-door versions include a left pocket door, single or multi-panel, that slides into a left opening inside the wall and a right pocket door, single or multi-panel, that slides into a right opening inside the wall.

Pocket door systems along the exterior of a building create an entry point for water or other debris to enter the structure between the pocket door and door opening. Water entering through the door opening can cause water damage to the building. Sill pans decrease water penetration at these entry points by collecting and directing the water and other debris outside the building.

SUMMARY

The embodiments disclosed herein each have several aspects no single one of which is solely responsible for the disclosure's desirable attributes. Without limiting the scope of this disclosure, its more prominent features will not be briefly discussed. After considering this discussion, and particularly after reading the section entitled "Detailed Description," one will understand how the features of the embodiments described herein provide advantages over existing systems, devices, and methods.

The following disclosure describes non-limiting examples of some embodiments. For instance, other embodiments of the disclosed systems and methods may or may not include the features described herein. Moreover, disclosed advantages and benefits can apply only to certain embodiments of the invention and should not be used to limit the disclosure.

In one aspect described herein, a method of installing a multi-piece, flexible, sill pan in a framed wall condition in a building wall that is configured to receive a pocket door for a doorway is disclosed. The framed wall condition includes an inner frame, an outer frame, and a first door stud together defining an internal space for receiving the pocket door. A bottom of the internal space being formed by a channel in a subfloor. The channel in the subfloor extending from the first door stud to a second door stud disposed on an opposite side of the doorway. The method comprises securing a first flexible end dam member between the inner and outer frames, and against the first door stud such that a first vertical seating flange of the first flexible end dam member contacts a generally vertical surface of the first door stud, a second vertical seating flange of the first flexible end dam member contacts a generally vertical surface of the inner frame, a third vertical seating flange of the first flexible end dam member contacts a generally vertical surface of the outer frame, and a generally horizontal base of the first flexible end dam member contacts a generally horizontal surface of the subfloor in the channel. The method further includes securing a second flexible end dam member against the second door stud such that a first vertical seating flange of the second flexible end dam member contacts a generally vertical surface of the second door stud, a second vertical seating flange of the second flexible end dam member contacts a generally vertical surface of the subfloor in the channel, and a generally horizontal base of the second flexible end dam member contacts a generally horizontal surface of the subfloor in the channel. The method further includes securing a flexible outside corner member to the outer frame and the subfloor such that a first vertical seating flange of the flexible outside corner member contacts a generally vertical surface of an end of the outer frame, a second vertical seating flange of the flexible outside corner member contacts a generally vertical surface of the outer frame, a third generally vertical seating flange of the flexible outside corner member contacts a generally vertical surface of the subfloor outside the channel, and a generally horizontal seating flange of the flexible outside corner member contacts a generally horizontal surface of the subfloor in the channel. The method further includes securing a flexible insert in the channel in the subfloor and between the first and second flexible end dams such that a base of the flexible insert contacts a generally horizontal surface of the subfloor in the channel and overlaps the horizontal seating flange of the flexible outside corner member, a first end of the flexible insert overlaps at least a portion of the horizontal seating flange of the first flexible end dam member, a second end of the flexible insert overlaps at least a portion of the horizontal seating flange of the second flexible end dam member, and a generally vertical seating flange of the flexible insert contacts a generally vertical surface of the subfloor in the channel.

In another aspect described herein, a method of installing a multi-piece, flexible, sill pan in a framed wall condition in a building wall that is configured to receive a first and a second pocket door for a doorway is disclosed. The framed wall condition including a first inner frame, a first outer frame, and a first door stud together defining a first internal space for receiving the first pocket door, a second inner frame, a second outer frame, and a second door stud together defining a second internal space for receiving the second pocket door, a first bottom of the first internal space and a second bottom of the second internal space being formed by a channel in a subfloor, the channel in the subfloor extending from the first door stud to the second door stud disposed on an opposite side of the doorway. The method comprises securing a first flexible end dam member between the first inner and outer frames, and against the first door stud such that a first vertical seating flange of the first flexible end dam member contacts a generally vertical surface of the first door stud, a second vertical seating flange of the first flexible end dam member contacts a generally vertical surface of the first inner frame, a third vertical seating flange of the first flexible end dam member contacts a generally vertical surface of the first outer frame, and a generally horizontal base of the first flexible end dam member contacts a generally horizontal surface of the subfloor in the channel. The method further comprises securing a second flexible end dam member between the second inner and outer frames, and against the second door stud such that a first vertical seating flange of the second flexible end dam member contacts a generally vertical surface of the second door stud, a second vertical seating flange of the second flexible end dam member contacts a generally vertical surface of the second inner frame, a third vertical seating flange of the second flexible end dam member contacts a generally vertical surface of the second outer frame, and a generally horizontal base of the second flexible end dam member contacts a generally horizontal surface of the subfloor in the channel. The method further comprising securing a first flexible outside corner member to the first outer frame and the subfloor such that a first vertical seating flange of the first flexible outside corner member contacts a generally vertical surface of an end of the first outer frame, a second vertical seating flange of the first flexible outside corner member contacts a generally vertical surface of the first outer frame, a third generally vertical seating flange of the first flexible outside corner member contacts a generally vertical surface of the subfloor outside the channel, and a generally horizontal seating flange of the first flexible outside corner member contacts a generally horizontal surface of the subfloor in the channel. The method further comprises securing a second flexible outside corner member to the second outer frame and the subfloor such that a first vertical seating flange of the second flexible outside corner member contacts a generally vertical surface of an end of the second outer frame, a second vertical seating flange of the second flexible outside corner member contacts a generally vertical surface of the second outer frame, a third generally vertical seating flange of the second flexible outside corner member contacts a generally vertical surface of the subfloor outside the channel, and a generally horizontal seating flange of the second flexible outside corner member contacts a generally horizontal surface of the subfloor in the channel. The method further comprises securing a flexible insert in the channel in the subfloor and between the first and second flexible end dam members such that a base of the flexible insert contacts a generally horizontal surface of the subfloor in the channel and overlaps the horizontal seating flanges of the first and second flexible outside corner members, a first end of the flexible insert overlaps at least a portion of the horizontal seating flange of the first flexible end dam member, a second end of the flexible insert overlaps at least a portion of the horizontal seating flange of the second flexible end dam member, and a generally vertical seating flange of the flexible insert contacts a generally vertical surface of the subfloor in the channel.

In another aspect described herein, a kit for a multi-piece, flexible, sill pan that is configured to be installed in a framed wall condition in a building wall that is configured to receive a pocket door for a doorway is disclosed. The framed wall condition including an inner frame, an outer frame, and a first door stud together defining an internal space for receiving the pocket door, a bottom of the internal space being formed by a channel in a subfloor, the channel in the subfloor extending from the first door stud to a second door stud disposed on an opposite side of the doorway. The kit comprises a first flexible end dam member that is configured to be secured between the inner and outer frames, and against the first door stud such that a first vertical seating flange of the first flexible end dam member contacts a generally vertical surface of the first door stud, a second vertical seating flange of the first flexible end dam member contacts a generally vertical surface of the inner frame, a third vertical seating flange of the first flexible end dam member contacts a generally vertical surface of the outer frame, and a generally horizontal base of the first flexible end dam member contacts a generally horizontal surface of the subfloor in the channel. The kit further comprises a second flexible end dam member that is configured to be secured against the second door stud such that a first vertical seating flange of the second flexible end dam member contacts a generally vertical surface of the second door stud, a second vertical seating flange of the second flexible end dam member contacts a generally vertical surface of the subfloor in the channel, and a generally horizontal base of the second flexible end dam member contacts a generally horizontal surface of the subfloor in the channel. The kit further comprises a flexible outside corner member that is configured to be secured to the outer frame and the subfloor such that a first vertical seating flange of the flexible outside corner member contacts a generally vertical surface of an end of the outer frame, a second vertical seating flange of the flexible outside corner member contacts a generally vertical surface of the outer frame, a third generally vertical seating flange of the flexible outside corner member contacts a generally vertical surface of the subfloor outside the channel, and a generally horizontal seating flange of the flexible outside corner member contacts a generally horizontal surface of the subfloor in the channel. The kit further comprises a flexible insert that is configured to be secured in the channel in the subfloor and between the first and second flexible end dams such that a base of the flexible insert contacts a generally horizontal surface of the subfloor in the channel and overlaps the horizontal seating flange of the flexible outside corner member, a first end of the flexible insert overlaps at least a portion of the horizontal seating flange of the first flexible end dam member, a second end of the flexible insert overlaps at least a portion of the horizontal seating flange of the second flexible end dam member, and a generally vertical seating flange of the flexible insert contacts a generally vertical surface of the subfloor in the channel.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not considered limiting of its scope, the disclosure will be described with additional specificity and detail through use of the accompanying drawings. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the drawing, can be arranged, substituted, combined, and designed in a wide variety of different configurations, all of which are explicitly contemplated and make part of this disclosure.

FIGS. 8A-C are close-up views of an embodiment of the placement of the first end dam within the building wall and specifically near a door stud in an internal space that receives a pocket door. FIG. 8A shows an embodiment of applying sealant within a channel of the internal space before placing the first end dam. FIG. 8B shows the first end dam placed on the applied sealant in the channel. FIG. 8C shows an embodiment of further securing the first end dam with fasteners, such as staples.

FIG. 9A shows an embodiment of applying sealant at the entrance to the internal space in the building wall before placing the outside corner member. FIG. 9B shows an embodiment of the outside corner member placed on the applied sealant. FIG. 9C shows an embodiment of wrapping the outside corner member around the entrance to the internal space in the building wall. FIG. 9D shows an embodiment of the outside corner member further secured to the building wall with fasteners, such as staples.

FIG. 10A shows an embodiment of applying sealant before placing the insert. FIG. 10B shows an embodiment of the insert placed in the channel. FIG. 10C shows an embodiment of removing a portion of a side of the insert aligning with an edge of the subfloor.

FIG. 11A shows an embodiment of applying sealant before placing the second end dam. FIG. 11B shows an embodiment of placing the second end dam near the door stud. FIG. 11C shows an embodiment of wrapping a portion of the second end dam around the building wall.

FIG. 11D shows an embodiment of the second end dam before the placement of the insert. FIG. 11E shows an embodiment of wrapping a portion of the insert around the edge of the subfloor. FIG. 11F shows an alternate embodiment to FIG. 11E where the portion of the insert is removed instead of being wrapped around the edge of the subfloor.

FIG. 13A shows an embodiment of applying sealant. FIG. 13B shows an embodiment of placing the first end dam. FIG. 13C shows an embodiment of securing the first end dam.

FIG. 14A shows an embodiment of applying sealant. FIG. 14B shows an embodiment of placing the second end dam. FIG. 14C shows an embodiment of securing the second end dam.

FIG. 15A shows an embodiment of applying sealant. FIG. 15B shows an embodiment of the first outside corner member positioned on the left outside frame of the building wall. FIG. 15C shows an embodiment of wrapping a portion of the first outside corner member around the building wall. FIG. 15D shows an embodiment of the first outside corner member secured on the building wall.

FIG. 16A shows an embodiment of applying sealant. FIG. 16B shows an embodiment of placing the second outside corner member on the right outside frame of the building wall. FIG. 16C shows an embodiment of wrapping a portion of the second outside corner member around the building wall. FIG. 16D shows an embodiment of the second outside corner member secured on the building wall.

FIG. 17A shows an embodiment of applying sealant before placing the insert on the building wall. FIG. 17B shows an embodiment of the insert positioned in the channel on the right side of the building wall, as shown in FIG. 12. FIG. 17C shows an embodiment of removing a portion of the insert.

DETAILED DESCRIPTION

Figure 1:
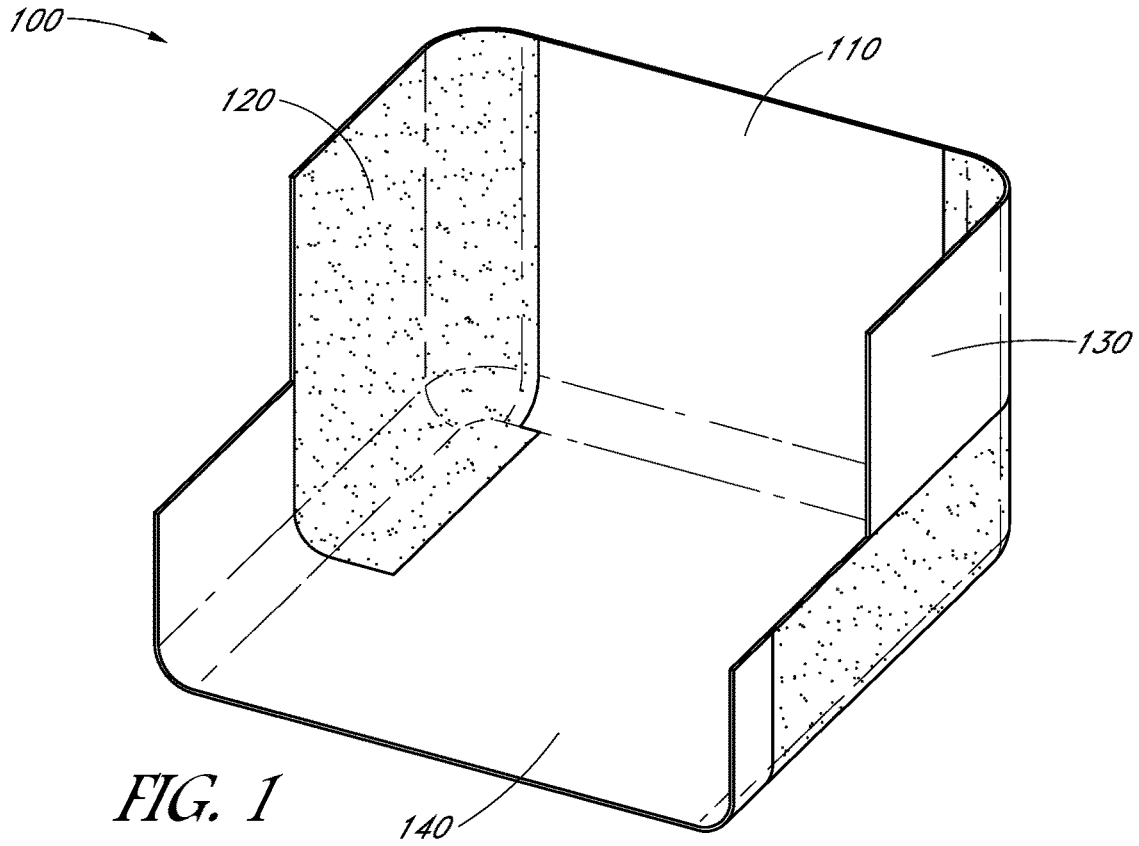
FIG. 1 is a front perspective view of an embodiment of a first end dam of a sill pan assembly.

The following detailed description is directed to certain specific embodiments of the invention. However, the invention can be embodied in a multitude of different ways. It should be apparent that the aspects herein may be embodied in a wide variety of forms and that any specific structure, function, or both being disclosed herein is merely representative of one or more embodiments of the invention. An aspect disclosed herein may be implemented independently of any other aspects and that two or more of these aspects may be combined in various ways. For example, a device (e.g., the illustrated embodiments of a multi-piece, flexible sill pan assembly for exterior pocket door systems such as single- and double-door versions as well as multi-panel pocket doors) may be implemented, or a method may be practiced, using any number of the aspects set forth herein. In addition, such a device may be implemented or such a method may be practiced using other structure, functionality, or structure and functionality in addition to, or other than one or more of the aspects set forth herein.

Certain embodiments of the disclosed sill pan assembly provide advantages over existing sill pan designs. For example, the flexibility of the material used for certain embodiments of the sill pan assembly allows the sill pan assembly to conform to size variations and tolerance ranges of the channel within the internal space. Certain embodiments of the sill pan assembly further do not sweat as caused by water condensation. Certain embodiments of the sill pan assembly are not hard plastic and thus are not susceptible to cracking or twisting due to heat. Certain embodiments of the sill pan assembly are not sticky and thus do not have compatibility issues with sealant. Certain embodiments of the sill pan assembly do not cause electrolysis with the concrete in contrast to metal sill pans.

The description of the disclosed implementations is provided to enable any person skilled in the art to make or use the present disclosure. Various modifications to these implementations will be readily apparent to those skilled in the art, and the generic principles defined herein may be applied to other implementations without departing from the spirit or scope of the disclosure. Thus, the present disclosure is not intended to be limited to the implementations shown herein but is to be accorded the widest scope consistent with the principles and novel features disclosed herein.

The foregoing description details certain embodiments of the devices and methods disclosed herein. It will be appreciated, however, that no matter how detailed the foregoing appears in text, the devices and methods can be practiced in many ways. It should be noted that the use of particular terminology when describing certain features or aspects of the invention should not be taken to imply that the terminology is being re-defined herein to be restricted to including any specific characteristics of the features or aspects of the technology with which that terminology is associated.

FIGS. 1-6 show the pieces of an embodiment of a sill pan assembly. The sill pan assembly comprises a first end dam 100, a second end dam 400, an insert 200, and an outside corner member 300. Each is described in more detail below.

Figure 2:
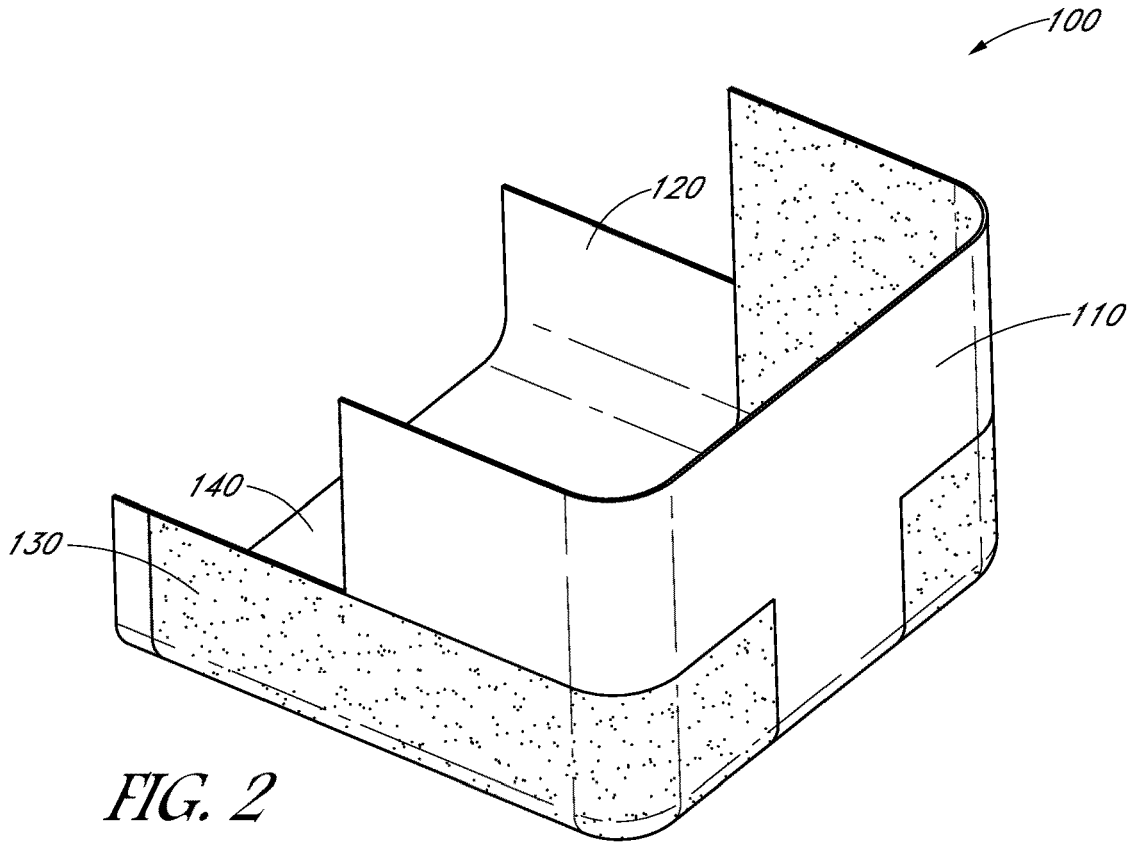
FIG. 2 is a rear perspective view of the first end dam shown in FIG. 1.

FIGS. 1 and 2 are perspective views of an embodiment of an end dam which may be configured as the first end dam 100 and the second end dam 400. The end dam 100 may have a first vertical seating flange 110, a second vertical seating flange 120, a third vertical seating flange 130, and a base 140. In some embodiments, the first vertical seating flange 110 and the base 140 are generally perpendicular to each other. The first vertical seating flange 110 may be generally perpendicular to the second vertical seating flange 120 and/or the third vertical seating flange 130. The second vertical seating flange 120 and the third vertical seating flange 130 may be generally parallel to each other. The second vertical seating flange 120 and the third vertical seating flange 130 may be generally L-shaped. In some embodiments, the second and/or third seating flanges 120, 130 may have another shape. In some embodiments, the second and/or third vertical seating flanges may have rounded or curved corners. In some embodiments, the second vertical seating flange 120 may have a shape that is different from the shape of the third seating flange 130.

In some embodiments, the height of the first vertical seating flange 120 and the length of the base 140 may be the same or similar. In other embodiments, the height of the first vertical seating flange 120 may be greater than or less than the length of the base 140.

The end dam 100 may be constructed of an asphalt-, butyl-, or petroleum-based material. Exemplary materials for the end dam 100 are sold by Fortifiber Building Systems Group Inc., Henry Company, and MFM Building Products Corp. In some embodiments, the material may have an adhesive backing. In some embodiments, the material is a flexible flashing material. In other embodiments, the end dam 100 may be constructed of other materials having water-resistant or water-impermeable properties, for example, but not limited to, butyl rubber, polyvinylidene fluoride, and acrylics. In some embodiments, the end dam 100 is constructed of one type of material. In other embodiments, the end dam 100 is constructed of two or more types of materials.

In some embodiments, the end dam 100 is an integral component. In other embodiments, the end dam 100 is constructed of two or more components. For example, the end dam 100 may be constructed by connecting one component to at least one other component. In some embodiments, the end dam 100 may be constructed by folding one component into the shape of the end dam 100 shown in FIG. 1 and connecting at least one other component, which assists in maintaining the shape of the end dam. For example, the solid white area of end dam 100, as shown in FIGS. 1 and 2, may be a first component, and the patterned areas of end dam 100, shown on the inside and outside, may be the other components. As shown in FIG. 1, the inside corners may each have an added component. As shown in FIG. 2, the outside corners may each have an added component.

In some embodiments, the end dam 100 may be formed by applying a first piece of adhesive-backed material to an end dam such that the first piece partially overlaps a cut edge of the end dam and then applying a second piece of adhesive-backed material to laminate the end dam. In such an embodiment, the first and second pieces of adhesive-backed material may assist in making the corners of the end dam. In some embodiments, the first and second pieces may not have an adhesive backing, but rather, are applied using a separate adhesive.

Figure 3:
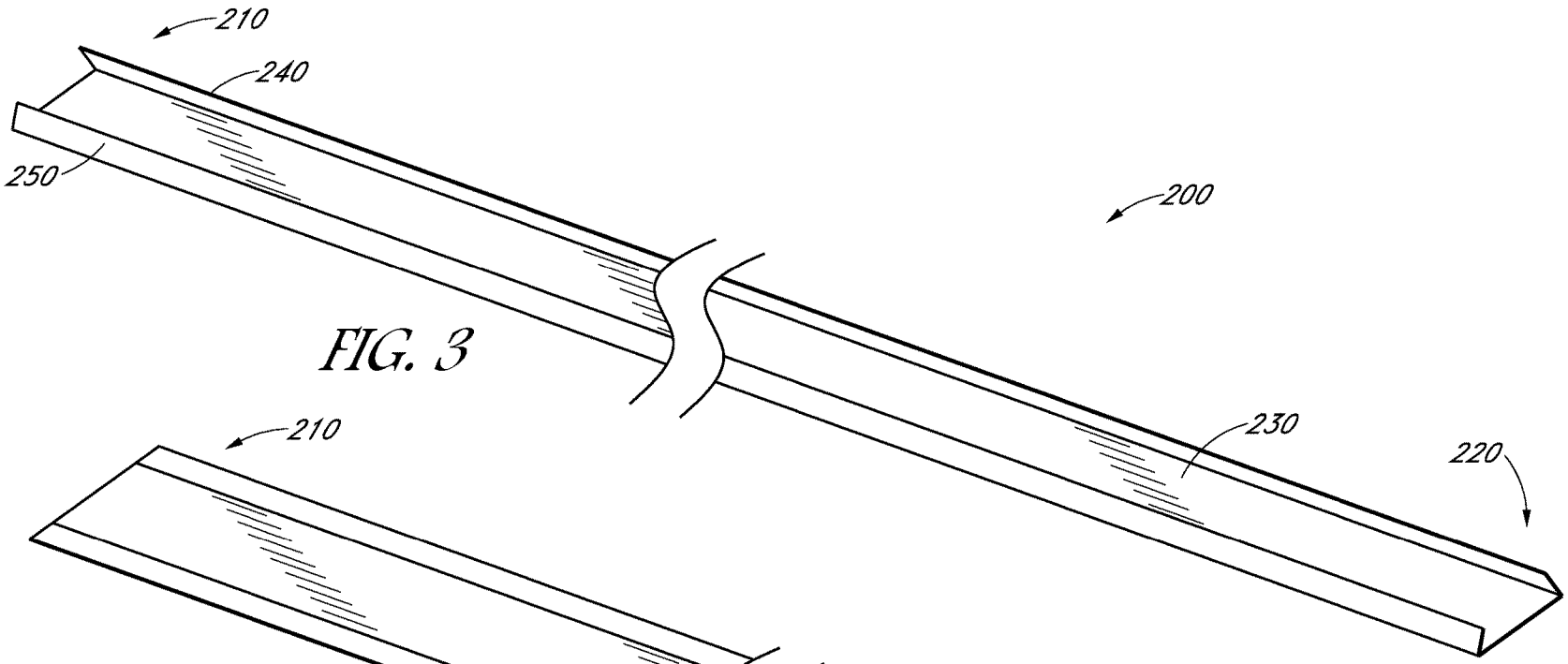
FIG. 3 is a perspective view of an embodiment of an insert of the sill pan assembly that has seating flanges folded-up to form a channel.
Figure 4:
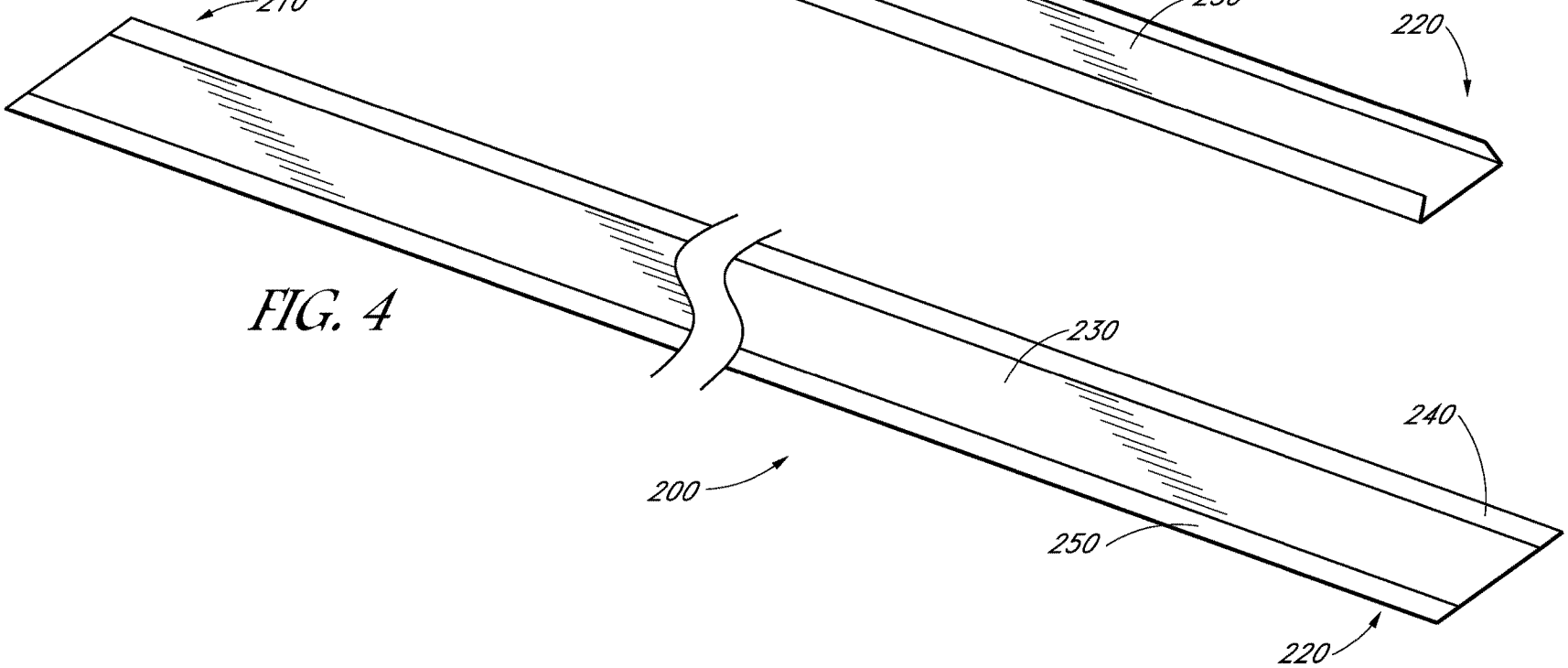
FIG. 4 is similar to FIG. 3 except that the seating flanges of the insert are folded flat.

FIGS. 3 and 4 are perspective views of an embodiment of an insert 200. The insert 200 is configured to extend the length of the door frame. In some embodiments, the insert 200 is a continuous piece. The insert 200 has a first end 210, a second end 220, a base 230, a first seating flange 240, and a second seating flange 250. In some embodiments, the first seating flange 240 and/or the second seating flange 250 are foldable and can be folded flat, as shown in FIG. 4. In some embodiments, the first seating flange 240 and/or the second seating flange 250 may extend away from the base 230 of the insert 200, as shown in FIG. 3. In some embodiments, creases provide an indication where the base 230 and the first and second flanges 240, 250 meet.

The insert 200 may be constructed of an asphalt-, butyl-, or petroleum-based material. Exemplary materials for the insert 200 are sold by Fortifiber Building Systems Group Inc., Henry Company, and MFM Building Products Corp. In some embodiments, the material may have an adhesive backing. In some embodiments, the material is a flexible flashing material. In other embodiments, the insert 200 may be constructed of other materials having water-resistant or water-impermeable properties, for example, but not limited to, butyl rubber, polyvinylidene fluoride, and acrylics. In some embodiments, the insert 200 is constructed of one type of material. In other embodiments, the insert 200 is constructed of two or more types of materials.

In some embodiments, the insert 200 is an integral component. In other embodiments, the insert 200 is constructed of two or more components. In some embodiments, the insert 200 may be constructed by connecting one component to at least one other component. For example, the insert 200 may be constructed by applying a first piece of adhesive-backed material to the base 230 of the insert 200 such that the first piece partially overlaps a back edge of the base 230 of the insert 200 and creates the first vertical seating flange 240. In some embodiments, the first piece may not have an adhesive backing, but rather, is applied using a separate adhesive.

Figure 6:
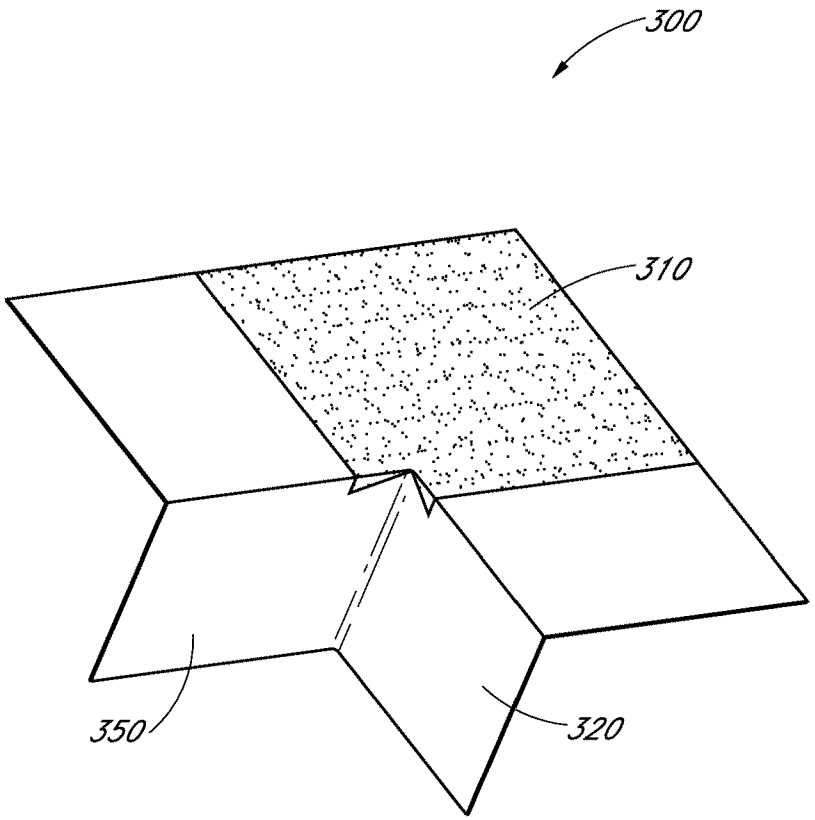
FIGS. 5 and 6 are perspective views of an embodiment of an outside corner member of the sill pan assembly.
Figure 5:
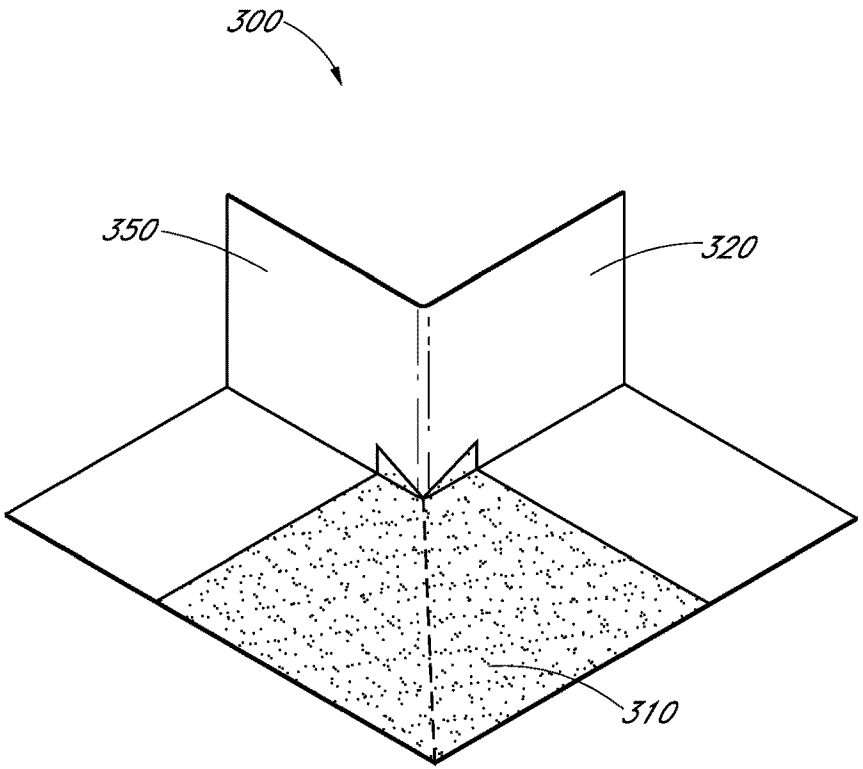

FIGS. 5 and 6 are perspective views of an embodiment of an outside corner member 300. The outside corner member 300 may have a first vertical seating flange 310 (see generally FIG. 7 for orientation), a second vertical seating flange 320, and a horizontal seating flange 350. The first vertical seating flange 310 is configured to be secured to an end of an outer frame, as shown in FIGS. 9B-D, 15B-D, 16B-D. The second vertical seating flange 320 and the horizontal seating flange 350 may be swapped depending on whether the outside corner member 300 is being placed on an outer frame on the left side of the door frame, as shown in FIGS. 10A and 15B-D, or on an outer frame on the right side of the door frame, as shown in FIGS. 16B-D.

Figure 9B:
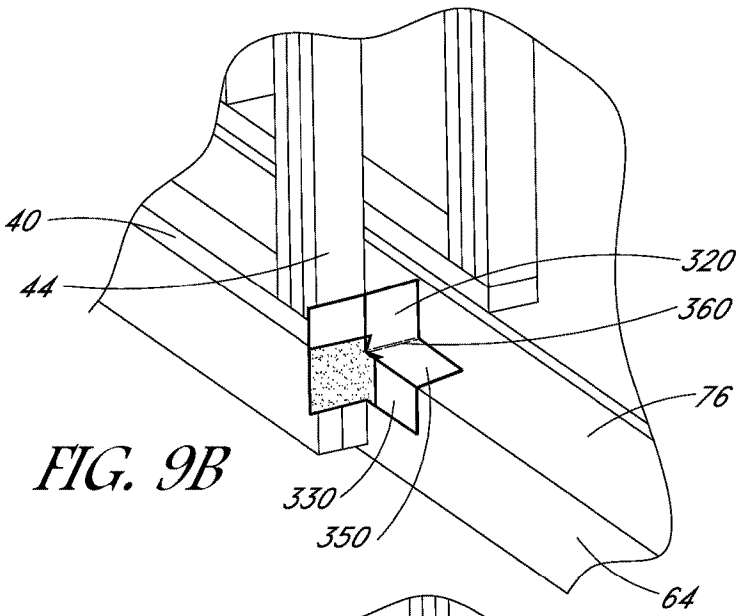
FIGS. 9A-D are close-up views of an embodiment of the placement of the outside corner member at an entrance to the internal space in the building wall.
Figure 9D:
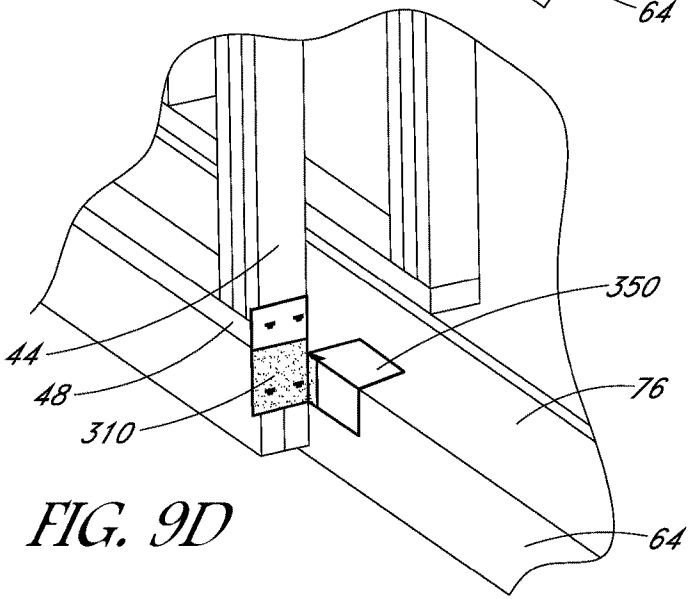

The first vertical seating flange 310 may be folded so that portions of it contact other vertical surfaces. In some embodiments, the first vertical seating flange 310 may be folded so that portions of the first vertical seating flange 310 becomes a third vertical seating flange 330, as shown in FIGS. 9B-D, 15B-D, and a fourth vertical flange 340, as shown in FIG. 10C, and described in further detail below.

The outside corner member 300 may be constructed of an asphalt-, butyl-, or petroleum-based material. Exemplary materials for the outside corner member 300 are sold by Fortifiber Building Systems Group Inc., Henry Company, and MFM Building Products Corp. In some embodiments, the material may have an adhesive backing. In some embodiments, the material is a flexible flashing material. In other embodiments, the outside corner member 300 may be constructed of other materials having water-resistant or water-impermeable properties, for example, but not limited to, butyl rubber, polyvinylidene fluoride, and acrylics. In some embodiments, the outside corner member 300 is constructed of one type of material. In other embodiments, the outside corner member 300 is constructed of two or more types of materials.

In some embodiments, the outside corner member 300 is an integral component. In other embodiments, the outside corner member 300 is constructed of two or more components. For example, the outside corner member 300 may be constructed by connecting one component to at least one other component. In some embodiments, the outside corner member 300 may be constructed by cutting one component and connecting at least one other component, which assists in creating the shape of the outside corner member 300. For example, the solid white area of the outside corner member 300, as shown in FIGS. 5 and 6, may be a first component, and the patterned areas of the outside corner member 300 may be the other components. In some embodiments, the outside corner member 300 may be formed by applying a first piece of adhesive-backed material to an outside corner member 300 such that the first piece partially overlaps a cut edge of the outside corner member and then applying a second piece of adhesive-backed material to the opposing side of the first piece, such that the first and second pieces connect to each other. In such an embodiment, the first and second pieces of adhesive-backed material may assist in making the outside corner member 300. In some embodiments, the first and second pieces may not have an adhesive backing, but rather, are applied using a separate adhesive.

The malleability of the material used to construct the sill pan assembly pieces 100, 200, 300, 400 is an aspect of the invention that allows the sill pan assembly to perform better than plastics. Plastics may be tough and semi-rigid so as to not bend. Plastics may become brittle and result in cracking or breakage in some environments, like wet or humid weather. The material used for embodiments of the sill pan assembly disclosed herein reduces the risk of cracking and breakage. Another aspect of the flexible material used to construct the end dams, inserts, and outside corner member, is that unlike metal, which can conduct heat, the material used here is not a good conductor of heat. Since the material used does not conduct heat well, this reduces the risk of condensation and damage to wood flooring, the subfloor, or inner/outer frames.

In some embodiments, the thickness of the material used to construct the end dams, insert, and/or outside corner member is about 25 mil. In some embodiments, the thickness of the material used is between 20 mil and 30 mil. In some embodiments, the thickness of the material used is between 23 mil and 27 mil. In some embodiments, the thickness of the material used is between 24.5 mil and 25.5 mil. In some embodiments, the thickness of the material used is 25 mil.

In some embodiments, one or more of the first and second end dams 100, 400 and the outside corner member 300 may be integral to the insert 200. Thus, embodiments of a sill pan assembly for a single pocket door preferably includes from one to four pieces. Similarly, embodiments of a sill pan assembly for a double pocket door preferably includes from one to five pieces. Of course, the embodiments disclosed herein are not limited to the specified number of pieces. For example, certain pieces, such as the insert, can be made from more than one piece.

Figure 7:
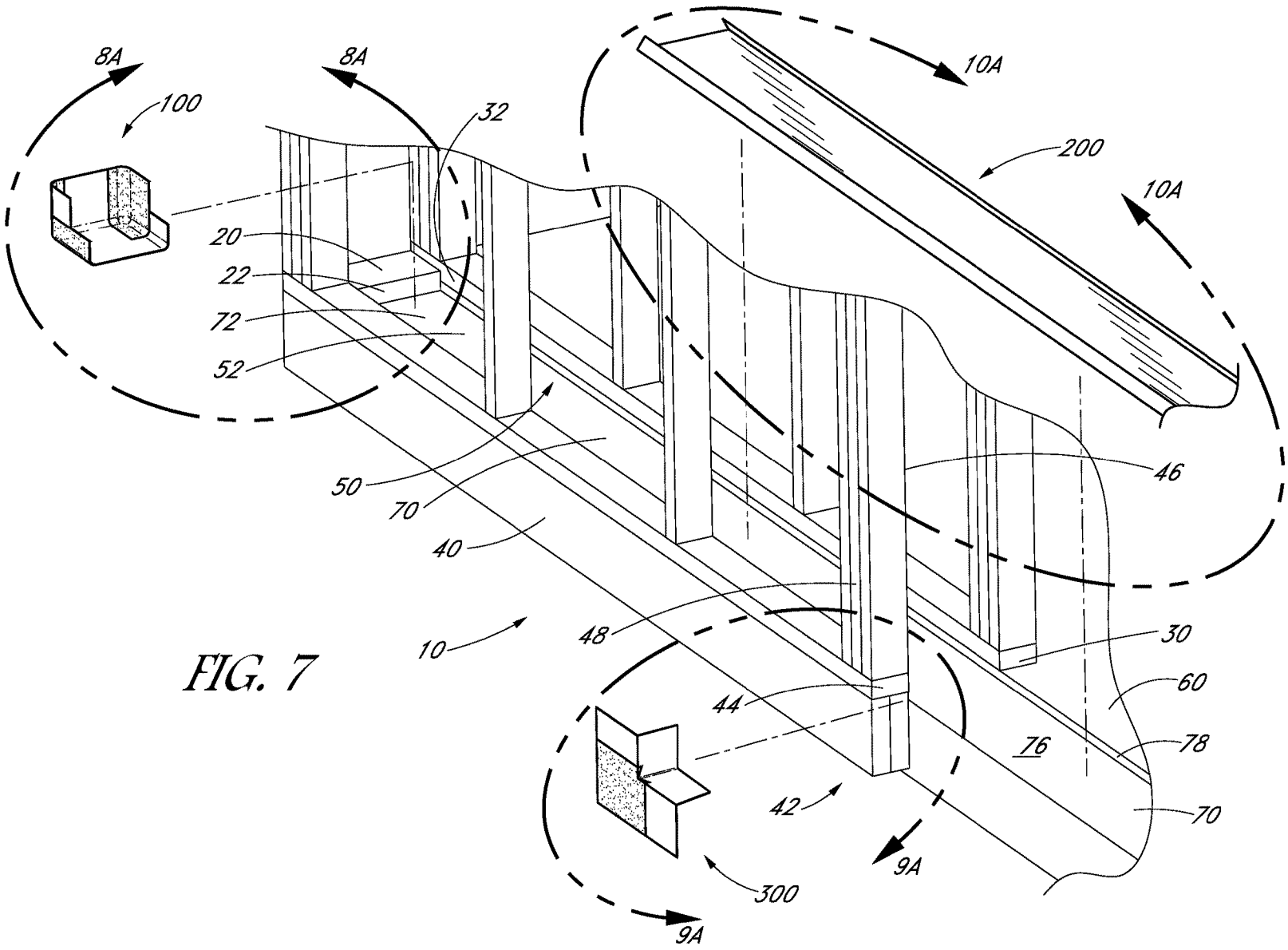
FIG. 7 is a perspective view of an embodiment of a framed building wall indicating locations for the placement of the first end dam, the insert, and the outside corner member of the sill pan assembly within a channel of the building wall.

FIG. 7 is a perspective view of an embodiment of a building wall 10 and the placement of the first end dam 100, the insert 200, and the outside corner member 300. The building wall 10 has a first door stud 20, an inner frame 30, and an outer frame 40. The first door stud 20 and the inner and outer frames 30, 40 define an internal space 50, which is configured to receive one or more panels of a pocket door. The first door stud 20 and the inner and outer frames 30, 40 further define an opening 52 in the internal spaced 50.

An end 42 of the outer frame 40 has a generally vertical surface 44. The outer frame 40 further has a first vertical surface 46, which faces the internal space 50, and a second vertical surface 48, which faces towards the exterior of the building. The inner frame 30 has a first vertical surface 32, which faces the internal space 50. The first door stud 20 has a generally vertical surface 22.

Figure 11B:
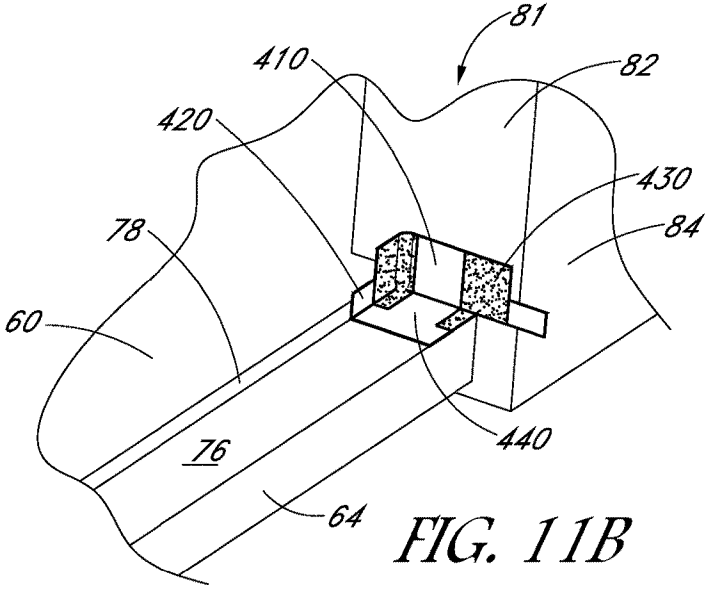
FIGS. 11A-C are close-up views of an embodiment of the placement of a second end dam, specifically near a door stud that is in a threshold of the building wall.
Figure 11A:
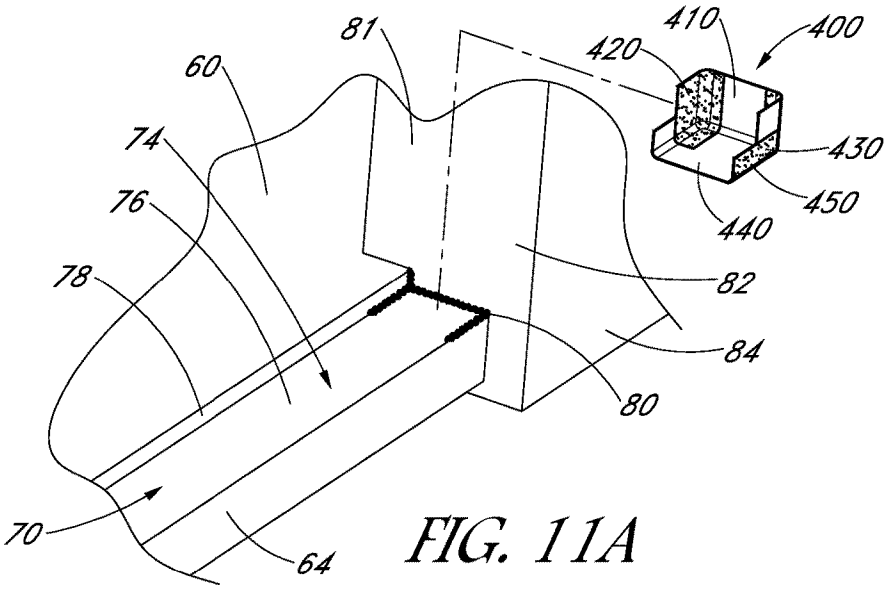
Figure 11C:
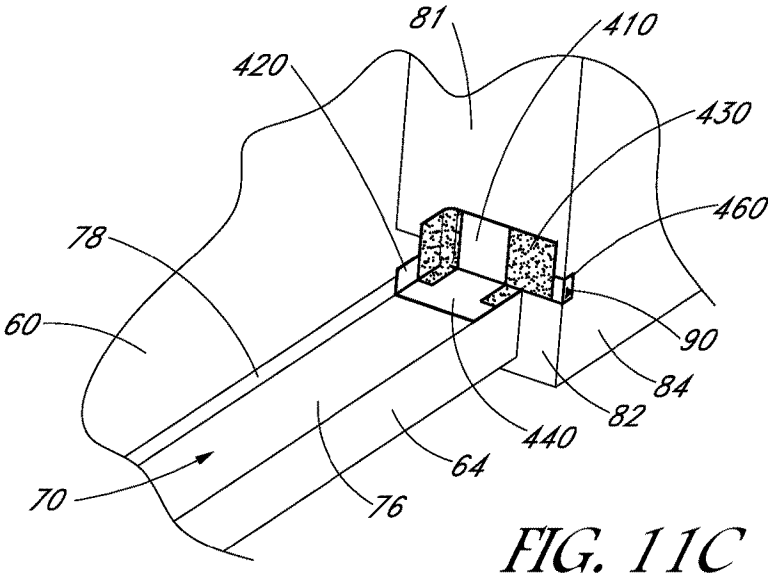

The building wall 10 sits on the subfloor 60. The subfloor 60 has a channel 70, which runs from a first end 72 to a second end 74. The second end 74 may be near a second door stud 81, as shown in FIGS. 11A-C, and described in more detail below. The channel 70 may have a horizontal surface 76 and a first vertical surface 78. The first vertical surface 78 of the channel 70 may be generally parallel with the vertical surface 32 of the inner frame 30. In some embodiments, the first vertical surface 78 of the channel 70 and the vertical surface 32 of the inner frame 30 meet so as to define a continuous vertical surface.

Figure 9A:
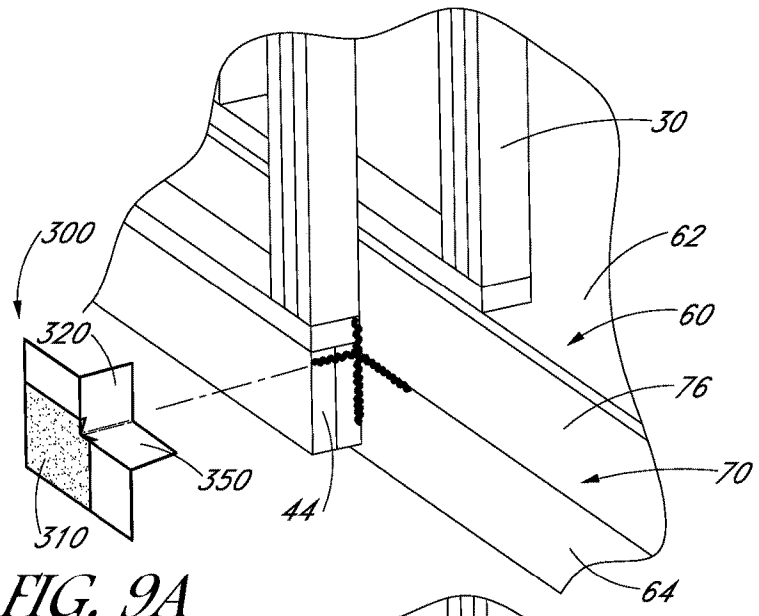

The subfloor 60 has a horizontal surface 62 and a first vertical surface 64 as is illustrated in FIG. 9A. The first vertical surface 64 of the subfloor 60 may be generally perpendicular to the vertical surface 44 of the end 42 of the outer frame 40. The first vertical surface 64 of the subfloor 60 may be generally parallel with the first vertical surface 78 of the channel 70.

FIGS. 8A-C are close-up views of an embodiment of the placement of the first end dam 100 in the channel 70. In certain embodiments, the first end dam 100 is disposed against the generally vertical surface 22 of the first door stud 20 in the internal space 50.

FIG. 8A shows an embodiment of applying sealant 80 before placing the first end dam 100. In some embodiments, the sealant 80 is applied in a discontinuous method, for example, separate beads or lines. In some embodiments, a sealant is not applied. In some embodiments, the sealant 80 is applied to the first end dam 100 before installing the first end dam 100.

FIG. 8B shows the first end dam 100 placed on the applied sealant 80. The base 140 of the first end dam 100 contacts the horizontal surface 76 of the channel 70. The first vertical seating flange 110 contacts the vertical surface 22 of the first door stud 20. The second vertical seating flange 120 contacts the first vertical surface 46 of the outer frame 40. The third vertical seating flange 130 contacts the first vertical surface 32 of the inner frame 30. Since the first end dam 100 is constructed of flexible material, it can easily be adjusted to fit rough openings or channels 70 with varying tolerances. During construction, the opening 52 and channel 70 defined partially by the first door stud 20, and the inner and outer frames 30, 40 may vary a certain degree from the measurements of the construction design. In some embodiments, the first end dam 100 is configured to accommodate variations in the sizes of the opening 52 and the channel 70. The first end dam 100 may fit a wider range of openings 52 and channels 70 than an end dam made from a non-flexible material. The flexible aspect of the first end dam 100 allows it to conform easily to oddly or irregularly shaped openings 52 and channels 70, while still providing a weather seal for the pocket door. The surfaces 110, 120, 130, 140 of the first end dam 100 can be bent and folded so as to contact irregular or oddly-shaped surfaces of the opening 52 and the channel 70.

FIG. 8C shows an embodiment of securing the first end dam 100 with one or more fasteners 90, such as staples. Other means for securing may be used. For example, in some embodiments, the first end dam 100 may be secured using nails, pins, screws, or adhesive. The material of the first end dam 100 provides self-sealing around the staples or other means for securing, thus maintaining the weather-tight seal for the pocket door. In some embodiments, a securing means is not used.

FIGS. 9A-D are close-up views of an embodiment of the placement of the outside corner member 300 on the outer frame 40 and the subfloor 60. FIG. 9A shows an embodiment of applying sealant 80 before placing the outside corner member 300. In some embodiments, the sealant 80 is applied in a discontinuous method, for example, separate beads or lines. In some embodiments, a sealant is not applied. In some embodiments, the sealant 80 may be applied to the outside corner member 300.

FIG. 9B shows an embodiment of placing the outside corner member 300 on the outer frame 40 and the subfloor 60. The first vertical seating flange 310 contacts the vertical surface 44 of the end 42 of the outer frame 40. The first vertical seating flange 310 may be folded so that the third vertical seating flange 330 contacts the first vertical surface 64 of the subfloor 60. In some embodiments, the outside corner member 300 may have a crease indicating where to fold the first vertical seating flange 310 and defining the third vertical seating flange 330.

In some embodiments, the outside corner member 300 does not have a crease indicating where to fold the first vertical seating flange 310. The horizontal seating flange 350 of the outside corner member 300 contacts the horizontal surface 76 of the channel 70 in the subfloor 60. As shown in FIG. 9B, the second vertical seating flange 320 may be parallel with the first vertical seating flange 310 and/or the vertical surface 44 of the end 42 of the outer frame 40. In some embodiments, there may be a crease defining the edge between the second vertical seating flange 320 and the first vertical seating flange 310. In some embodiments, there may not be a crease.

Figure 9C:
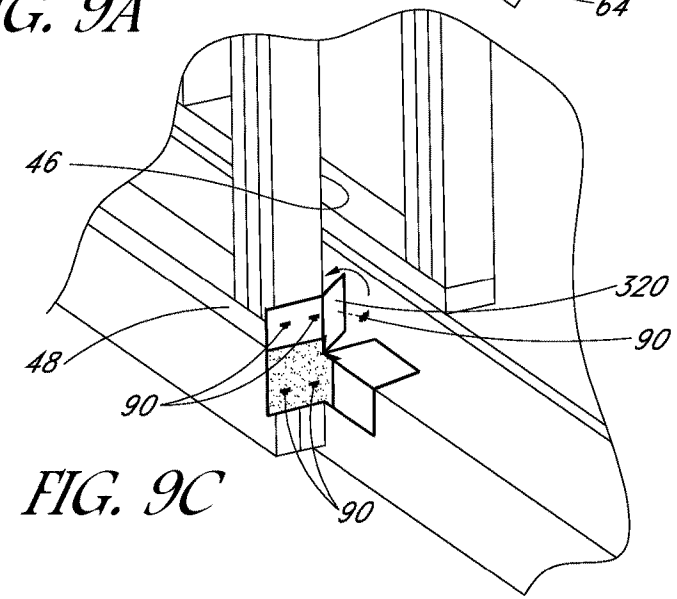

FIGS. 9C-D show an embodiment of wrapping the second vertical seating flange 320 around the end 42 of the outer frame 40 so that the second vertical seating flange 320 contacts the first vertical surface 46 of the outer frame 40, which faces the internal space 50. In some embodiments, the edge 360 between the horizontal seating flange 350 and the second vertical seating flange 320 of the outside corner member 300 is cut to allow the second vertical seating flange 320 to contact the first vertical surface 46 of the outer frame 40, as shown in FIG. 9C. In some embodiments, the outside corner member 300 may come pre-cut. In some embodiments, the outside corner member 300 is formed such that the horizontal seating flange 350 and the second vertical seating flange 320 are not connected so as to not need to be cut.

As shown in FIG. 9C, in certain embodiments, the first vertical seating flange 310 of the outside corner member 300 may be secured to the end 42 of the outer frame 40 using one or more fasteners 90, such as staples. The second vertical seating flange 320 may be secured to the outer frame 40 using one or more fasteners 90. In some embodiments, the outside corner member 300 is secured using nails, pins, screws, adhesive, or other securing means. The material of the outside corner member 300 provides self-sealing around the staples or other means for securing, thus maintaining the weather-tight seal for the door frame. In some embodiments, a securing means is not used.

As shown in FIG. 9D, a portion of the first vertical seating flange 310 may extend farther than the vertical surface 44 of the end 42 of the outer frame 40. As shown in FIG. 10C, this portion of the first vertical seating flange 310 may be folded to contact the second vertical surface 48 of the outer frame 40, defining a fourth vertical seating flange 340 of the outside corner member 300.

Figure 10A:
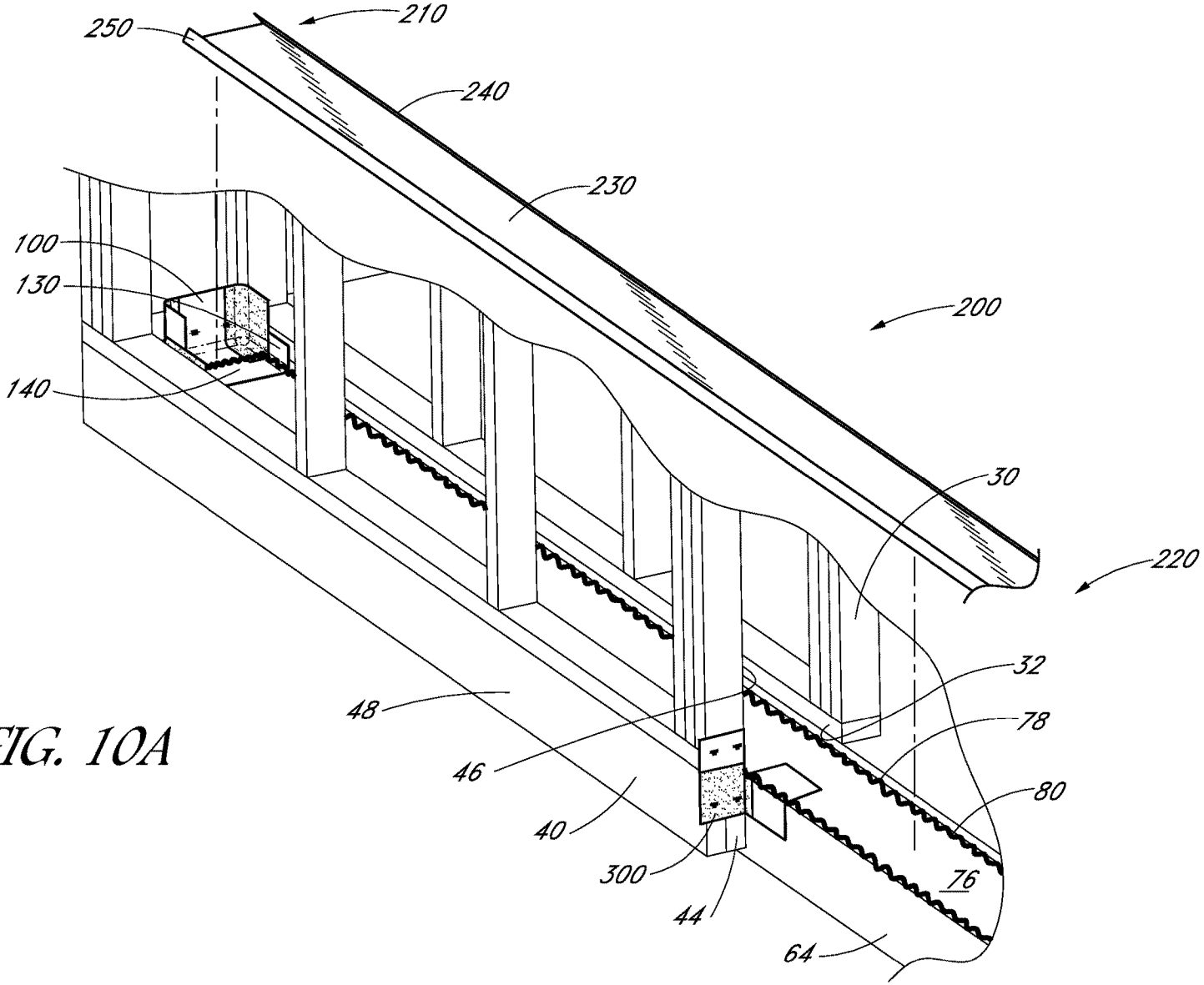
FIGS. 10A-C are close up views of an embodiment of the placement of a left side portion of the insert on the first end dam and along the channel in the building wall.
Figure 10B:
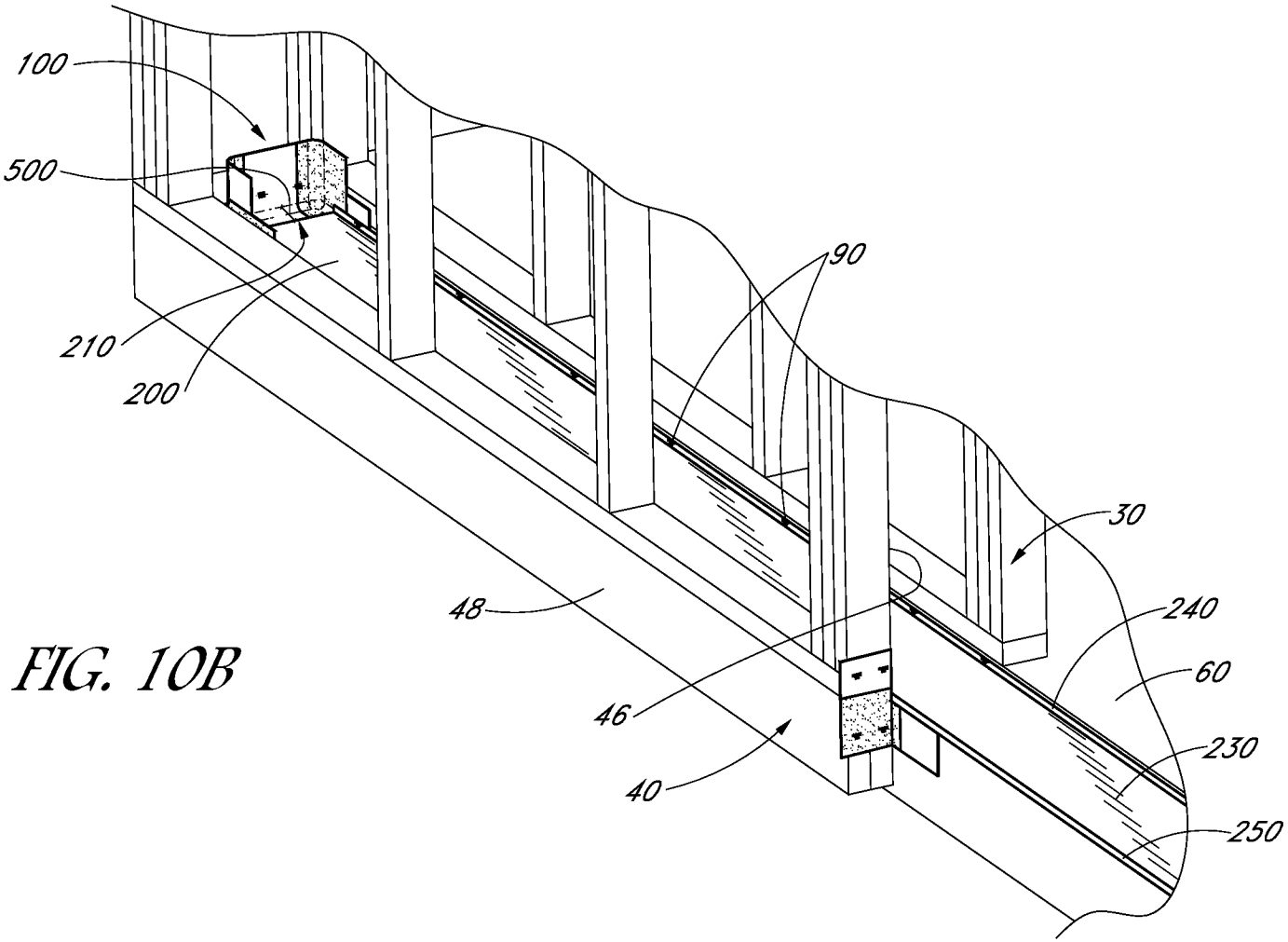
Figure 10C:
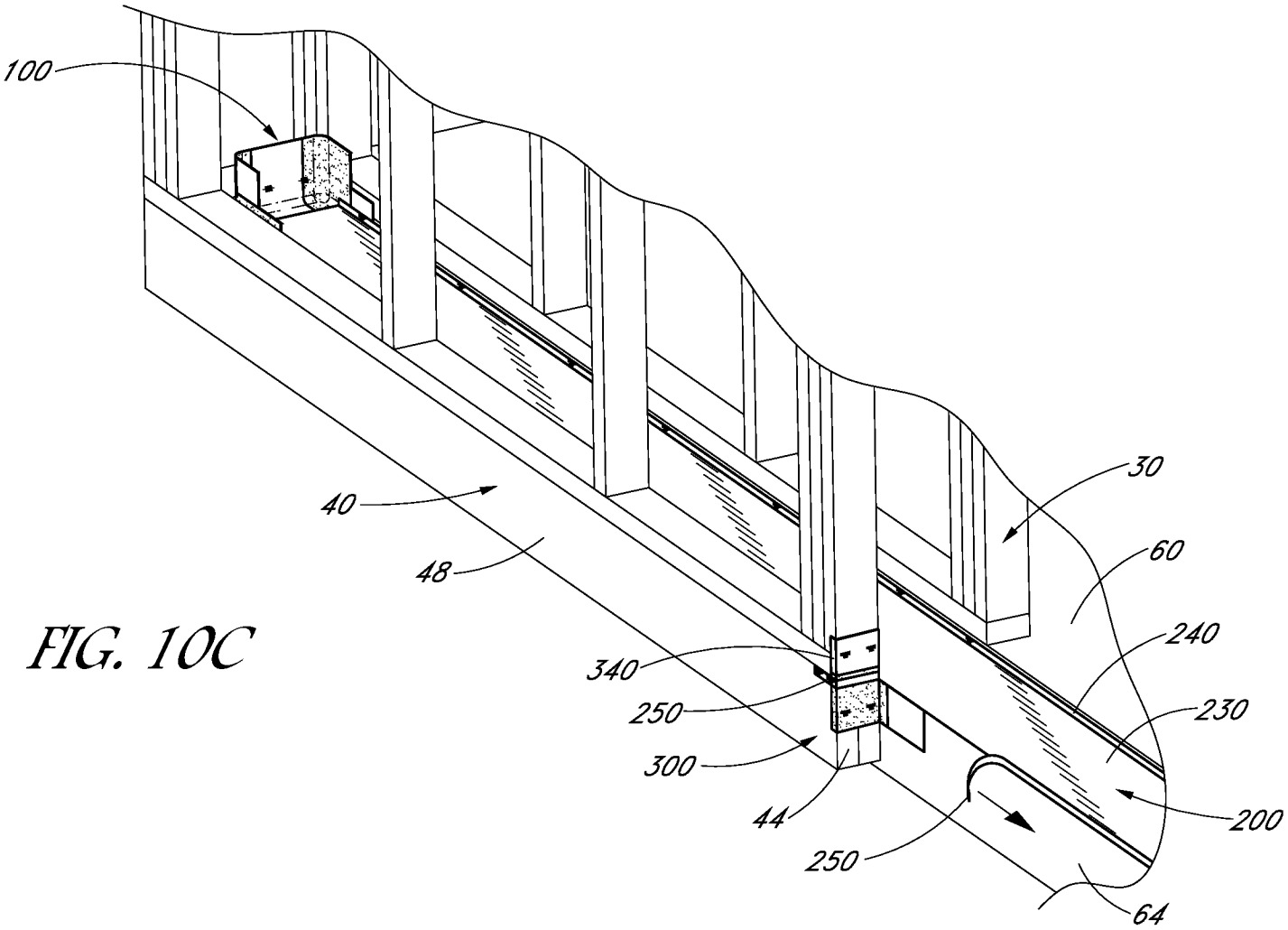

FIGS. 10A-C are close up views of an embodiment of the placement of the insert 200 along the channel 70 in the subfloor 60. FIG. 10A shows an embodiment of applying sealant 80 before placing the insert 200. As is illustrated in FIG. 10A, the sealant 80 is applied to the first end dam 100, outside corner member 300, and the channel 70. In some embodiments, the sealant 80 is applied in a discontinuous method, for example, separate beads or lines. In some embodiments, a sealant is not applied. In some embodiments, the sealant 80 may be applied to the insert 200.

FIG. 10B shows a first end 210 of the insert 200 positioned near the end dam 100 and the first door stud 20. In some embodiments, the insert 200 is trimmed to fit the length of the channel 70. As shown in FIG. 10B, there may be a gap 500 between the first end 210 of the insert 200 and the first seating flange 110 of the first end dam 100. In some embodiments, there may be no gap 500. The base 230 of the insert 200 may partially overlap the base 140 of the first end dam 100 or vice versa. In some embodiments, the base 230 of the insert 200 completely covers the base 140 of the first end dam 100. In some embodiments, the base 230 of the insert 200 partially covers the base 140 of the first end dam 100 so that a portion of the base 140 of the first end dam 100 is exposed. The base 230 of the insert 200 contacts the horizontal surface 76 of the channel 70 in the subfloor 60.

As shown in FIG. 10B, the first vertical seating flange 240 of the insert 200 contacts the first vertical surface 78 of the channel 70. In some embodiments, the first vertical seating flange 240 of the insert 200 may extend farther than the first vertical surface 78 of the channel 70. In some embodiments, a portion of the first vertical seating flange 240 of the insert 200 may contact the first vertical surface 32 of the inner frame 30. In some embodiments, any excess material of the first vertical seating flange 240 of the insert 200 may be removed, for example, by trimming the material. The first vertical seating flange 240 of the insert 200 may be secured using one or more fasteners 90, such as staples. Other means for securing may be used. For example, in some embodiments, the insert 200 may be secured using nails, pins, screws, or adhesive. The material of the insert 200 provides self-sealing around the staples or other means for securing, thus maintaining the weather-tight seal for the door frame. In some embodiments, a securing means is not used.

Figure 11E:
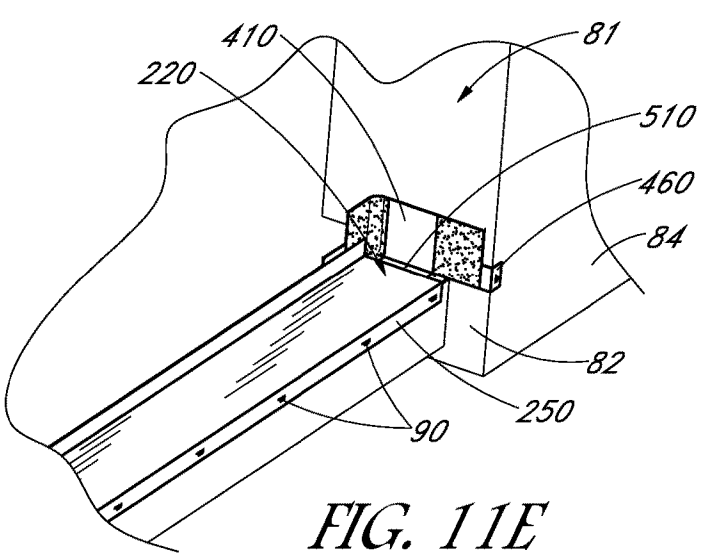
FIGS. 11D-F are close-up views of a right side portion of the insert illustrated in FIG. 10A being placed on the second end dam and along the channel in the building wall.

In some embodiments, a portion of the second vertical seating flange 250 of the insert 200 contacts the first vertical surface 46 of the outer frame 40. In some embodiments, the portion of the insert 200 that contacts the first vertical surface 46 of the outer frame 40 is the portion that extends through the internal space 50. In some embodiments, a portion of the second vertical seating flange 250 of the insert 200 that does not extend through the internal space 50 is removed, as shown in FIGS. 10C and 11A-C, and F. In some embodiments, the portion of the second vertical seating flange 250 that extends across the threshold is folded down and contacts the first vertical surface 64 of the subfloor 60, as shown in FIG. 11E. In some embodiments, a portion of the second vertical seating flange 250 of the insert 200 is wrapped around the end 42 of the outer frame 40. The second vertical seating flange 250 may contact the first seating flange 310 of the outside corner member 300 and wrap around to contact the second vertical surface 48 of the outer frame 40 and the fourth vertical seating flange 340 of the outside corner member 300.

FIGS. 11A-C are close-up views of an embodiment of the placement of the second end dam 400 on the building wall. In certain embodiments, the second end dam 400 is disposed against the second door stud 81. The second door stud 81 is not located in an internal space but instead is in the doorway.

The second end dam 400 has a first vertical seating flange 410, a second vertical seating flange 420, a third vertical seating flange 430, and a base 440. The second end dam 400 is placed at the second end 74 of the channel 70. The second door stud 81 has a first vertical surface 82 and a second vertical surface 84. The first vertical surface 82 is generally perpendicular to the horizontal surface 76 of the channel 70. FIG. 11A shows an embodiment of applying sealant 80 before placing the second end dam 400. In some embodiments, the sealant 80 is applied in a discontinuous method, for example, separate beads or lines. In some embodiments, a sealant is not applied. In some embodiments, the sealant 80 may be applied to the second end dam 400.

FIG. 11B shows an embodiment of placing the second end dam 400 at the second end 74 of the channel 70. The base 440 of the second end dam 400 contacts the horizontal surface 76 of the channel 70. The first vertical seating flange 410 of the second end dam 400 contacts the first vertical surface 82 of the second door stud 81. The second vertical seating flange 420 contacts the vertical surface 78 of the channel 70 in the subfloor 60. In some embodiments, the edge 450 between the base 440 and the third vertical seating flange 430 is trimmed to allow the third vertical seating flange 430 to contact the first vertical surface 82 of the second door stud 81, as shown in FIG. 11B. In some embodiments, the second end dam 400 may come pre-cut. In some embodiments, the end dam 400 is formed such that the base 440 and the third vertical seating flange 430 are not connected so as to not need to be cut. In such embodiments, the second end dam 400 may have a first vertical flange 410, a second vertical flange 420, and a base 440.

FIG. 11C shows an embodiment of wrapping a portion 460 of the third vertical flange 430 of the second end dam 400 around the second door stud 81. The portion 460 of the third vertical flange 430 contacts the second vertical surface 84 of the door stud 81. The portion 460 may be secured using one or more staples 90. Other means for securing may be used. For example, in some embodiments, the second end dam 400 may be secured using nails, pins, screws, or adhesive. The material of the second end dam 400 provides self-sealing around the staple 90 or other means for securing, thus maintaining the weather-tight seal for the door. In some embodiments, a securing means is not used. In some embodiments, the third vertical seating flange 430 does not extend further than the first vertical surface 82 of the second door stud 81.

Figure 11F:
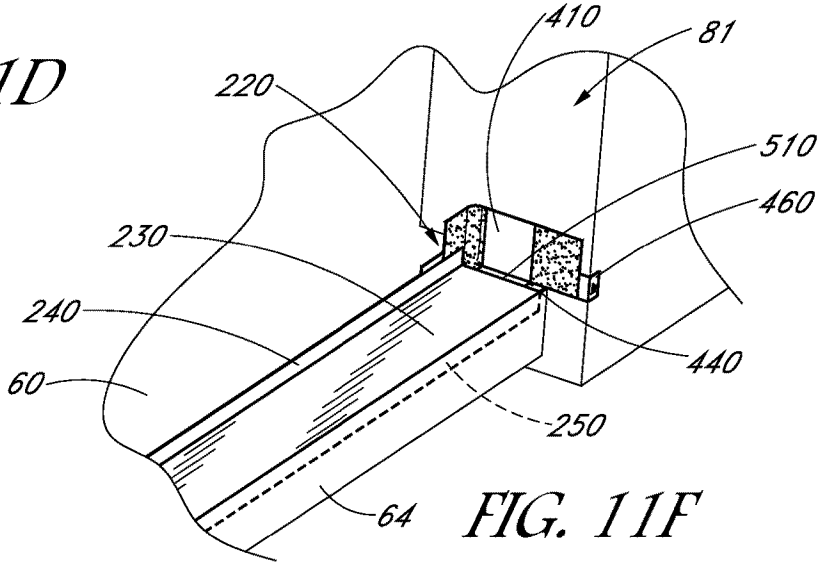
Figure 11D:
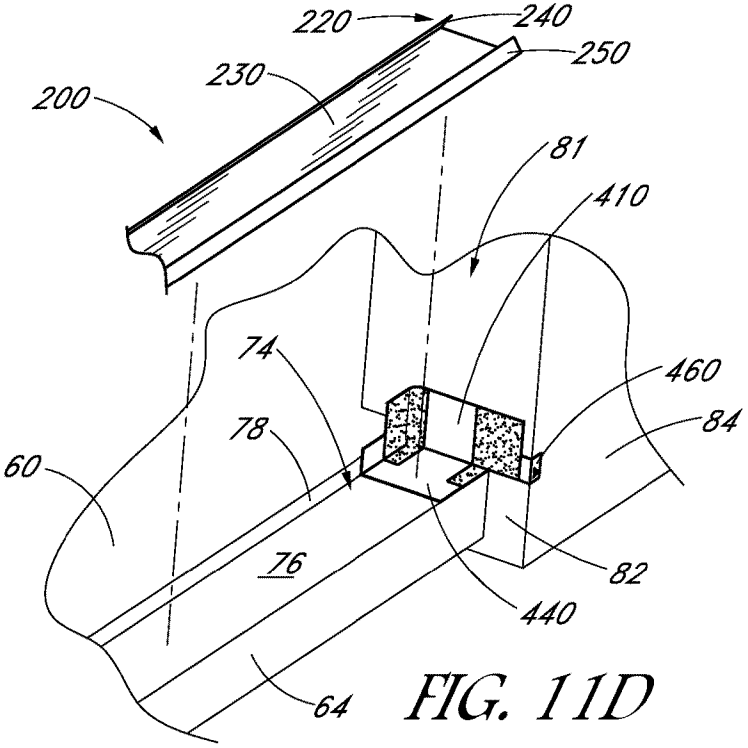

FIGS. 11D-F are close-up views of the placement of the second end 220 of the insert 200 in the second end 74 of the channel 70 in the subfloor 60. As shown in FIG. 11D-E, in some embodiments, the second end 220 of the insert 200 is positioned near the second end dam 400 and the second door stud 81 so that there is a gap 510 between the second end 220 of the insert 200 and the first vertical seating flange 410 of the second end dam 400. In some embodiments, there is no gap 510. In some embodiments, the second end 220 of the insert 200 abuts the first vertical seating flange 410 of the second end dam 400. The base 230 of the insert 200 may partially overlap the base 440 of the second end dam 400 or vice versa. In some embodiments, the base 230 of the insert 200 completely covers the base 440 of the second end dam 400. In some embodiments, the base 230 of the insert 200 partially covers the base 440 of the second end dam 400 so that a portion of the base 440 of the second end dam 400 is exposed. The base 230 of the insert 200 contacts the horizontal surface 76 of the channel 70 in the subfloor 60.

As shown in FIG. 11E, in some embodiments, the portion of the second vertical seating flange 250 that extends across the threshold is folded down and contacts the first vertical surface 64 of the subfloor 60. As shown in FIG. 11F, in some embodiments a portion of the second vertical seating flange 250 of the insert 200 is removed. In some embodiments, the insert 200 may not have a second vertical seating flange 250. In some embodiments, the second vertical seating flange 250 may extend partially along the length of the insert 200.

FIGS. 7-11F show the installation of the first and second end dams 100, 400, insert 200, and outside corner member 300 for a pocket door where the door is received on the left side of the door frame. From this, one skilled in the art would understand how to adjust the installation of the first and second end dams 100, 400, insert 200, and outside corner member 300 for a pocket door where the door is received on the right side of the door frame.

Figure 12:
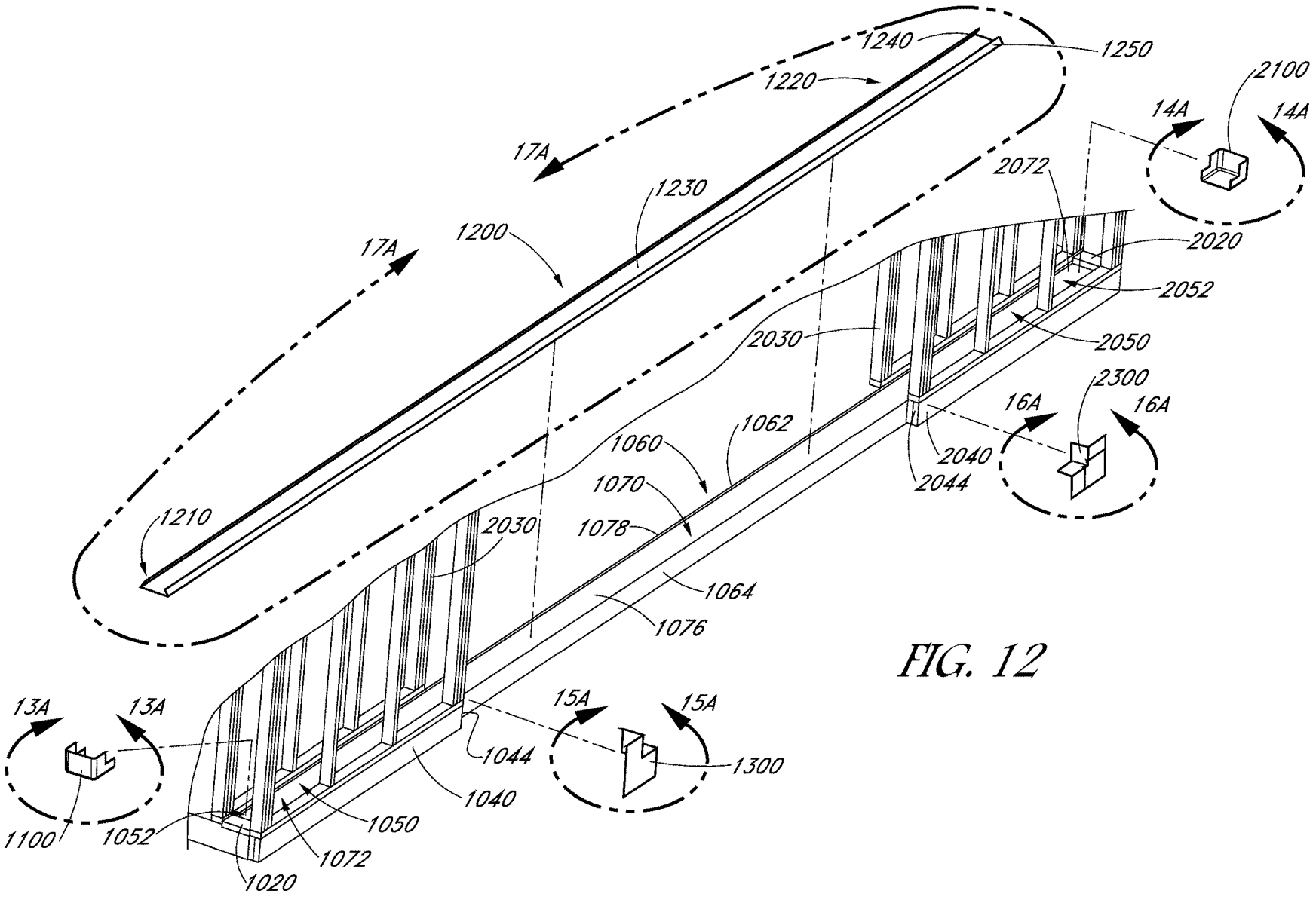
FIG. 12 is a perspective view of a building wall having two internal spaces for receiving a double pocket door and the placement of the end dams, outside corner members, and insert.

FIG. 12 is a perspective view of a building wall 1010 having two internal spaces 1050, 2050 for receiving pocket doors and the placement of the first and second end dams 1100, 2100, the first and second outside corner members 1300, 2300, and insert 1200. The building wall 1010 has a first door stud 1020, a second door stud 2020, a first inner frame 1030, a second inner frame 2030, a first outer frame 1040, and a second outer frame 2040. The first door stud 1020, and the first inner and outer frames 1030, 1040 define the internal space 1050, which is configured to receive a left pocket door. The first door stud 1020, and the first inner and outer frames 1030, 1040 further define a first opening 1052, which receives the first end dam 1100. The second door stud 2020, and the second inner and outer frames 2030, 2040 define a second opening 2052, which receives the second end dam 2100. The first and second door studs 1020, 2020 each has a generally vertical surface 1022, 2022 respectively.

The ends 1042, 2042 of the first and second outer frames 1040, 2040 each have a generally vertical surface 1044, 2044, respectively. The first and second outer frames 1040, 2040 each have a first vertical surface 1046, 2046, respectively, wherein each faces the internal space 1050, 2050, respectively, and a second vertical surface 1048, 2048, wherein each faces towards the exterior of the building. The first and second inner frames 1030, 2030 each has a first vertical surface 1032, 2032, which faces the internal space 1050, 2050, respectively.

The building wall 1010 sits on the subfloor 1060. The subfloor 1060 has a channel 1070, which runs from a first end 1072 to a second end 2072. The first end 1072 of the channel 1070 is near the first door stud 1020 and the second end 2072 of the channel 1070 is near the second door stud 2020. The channel 1070 extends through the internal spaces 1050, 2050. The channel 1070 may have a horizontal surface 1076 and a first vertical surface 1078. The first vertical surface 1078 of the channel 1070 may be generally parallel with the vertical surfaces 1032, 2032 of the first and second inner frames 1030, 2030. The subfloor 1060 has a horizontal surface 1062 and a first vertical surface 1064. The first vertical surface 1064 of the subfloor 1060 may be generally perpendicular to the vertical surfaces 1044, 2044 of the ends 1042, 2042 of the first and second outer frames 1040, 2040. The first vertical surface 1064 of the subfloor 1060 may be generally parallel with the first vertical surface 1078 of the channel 1070.

Figure 13B:
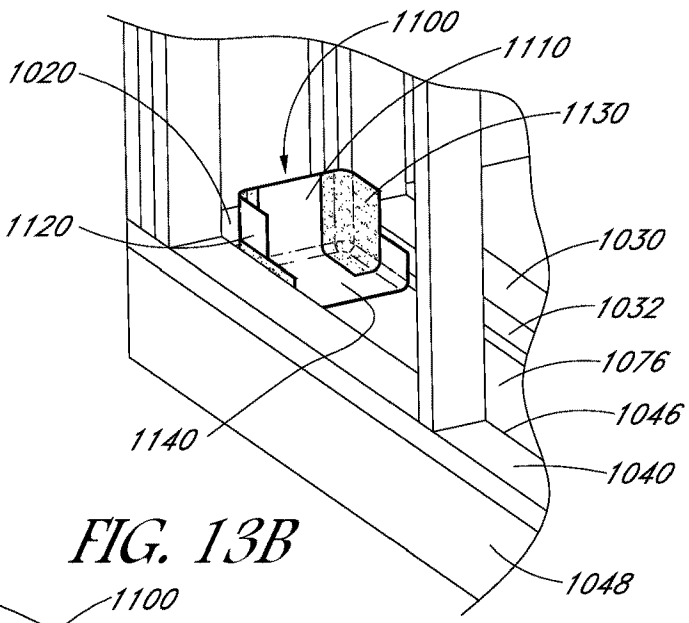
FIGS. 13A-C are close-up views of an embodiment of placing a first end dam, specifically in the internal space for receiving a first pocket door on the left side of the building wall as shown in FIG. 12.
Figure 13C:
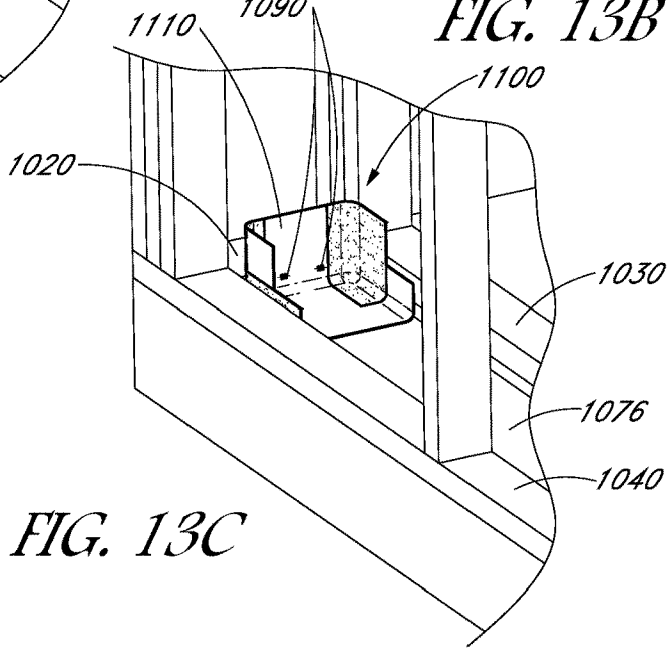
Figure 13A:
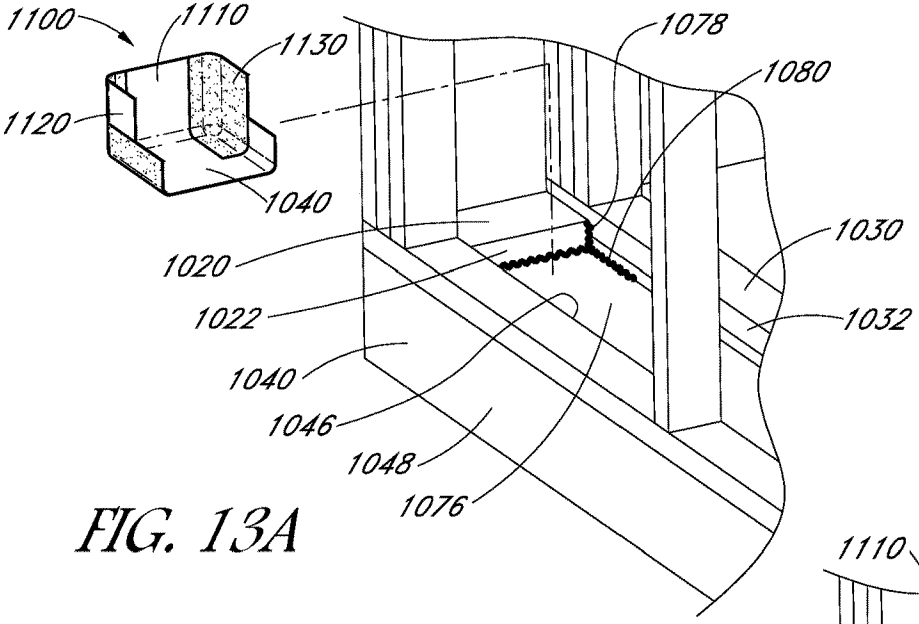

FIGS. 13A-C are close-up views of an embodiment of placing the first end dam 1100 in the opening 1052. FIG. 13A shows an embodiment of applying sealant 1080. In some embodiments, the sealant 1080 is applied in a discontinuous method, for example, separate beads or lines. In some embodiments, a sealant is not applied. In some embodiments, the sealant 1080 may be applied to the first end dam 1100.

FIG. 13B shows the first end dam 1100 placed in the opening 1052. The base 1140 of the first end dam 1100 contacts the horizontal surface 1076 of the channel 1070. The first vertical seating flange 1110 contacts the vertical surface 1022 of the first door stud 1020. The second vertical seating flange 1120 contacts the first vertical surface 1046 of the first outer frame 1040. The third vertical seating flange 1130 contacts the first vertical surface 1032 of the first inner frame 1030. Since the first end dam 1100 is constructed of flexible material, it can easily be adjusted to fit rough openings or channels 1070 with varying tolerances. During construction, the opening 1052 and channel 1070 defined by the first door stud 1020, and the first inner and outer frames 1030, 1040 may vary a certain degree from the measurements of the construction design. In some embodiments, the first end dam 1100 is configured to accommodate variations in the sizes of the opening 1052 and the channel 1070. The first end dam 1100 may fit a wider range of openings 1052 and channels 1070 than an end dam made from a non-flexible material. The flexible aspect of the first end dam 1100 allows it to conform easily to oddly or irregularly shaped openings 1052, while still providing a weather seal for the pocket door. The surfaces 1110, 1120, 1130, 1140 of the first end dam 1100 can be bent and folded so as to contact irregular or oddly-shaped surfaces of the opening 1052 and the channel 1070.

As shown in FIG. 13C the first end dam 1100 may be secured with one or more staples 1090. Other means for securing may be used. For example, in some embodiments, the first end dam 1100 may be secured using nails, pins, screws, or adhesive. The material of the first end dam 1100 provides self-sealing around the staples or other means for securing, thus maintaining the weather-tight seal for the door. In some embodiments, a securing means is not used.

Figure 14B:
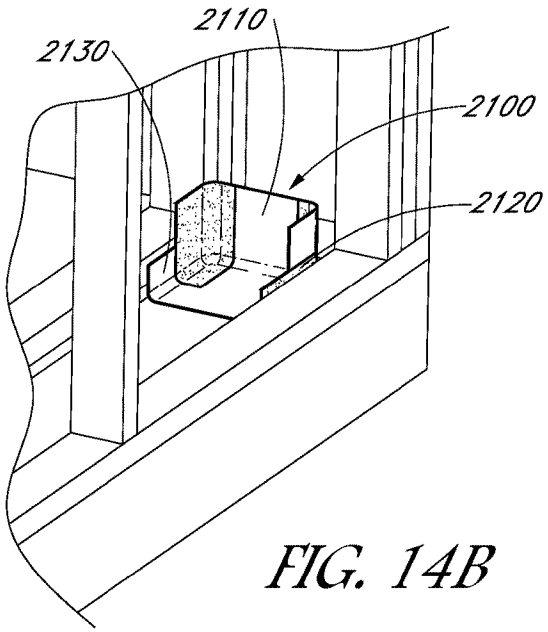
FIGS. 14A-C are close up views of an embodiment of placing a second end dam, specifically in the internal space for receiving a second pocket door on the right side of the building wall as shown in FIG. 12.
Figure 14A:
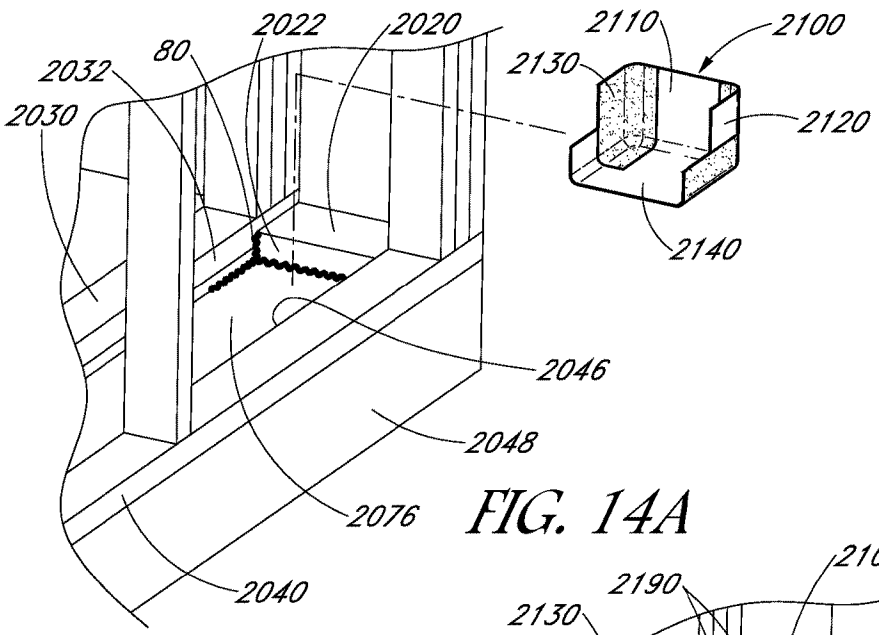
Figure 14C:
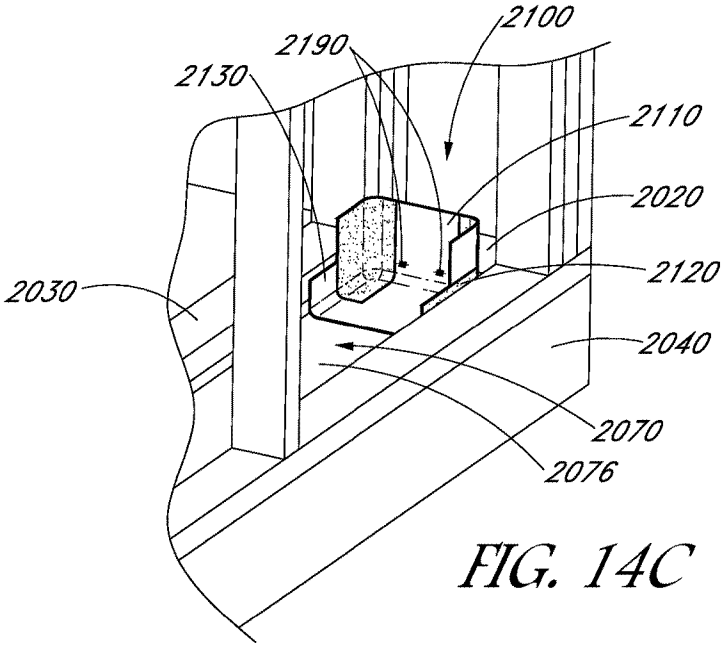

FIGS. 14A-C are close up views of an embodiment of placing the second end dam 2100 on the building wall, specifically in the internal space for receiving a pocket door on the right side of the building wall as shown in FIG. 12. The right side installation is a mirror image of the left side installation. FIG. 14A shows an embodiment of applying sealant 1080. FIG. 14B shows the second end dam 2100 placed in opening 2052. As shown in FIG. 14C, the second end dam 2100 may be secured using one or more staples.

Figure 15B:
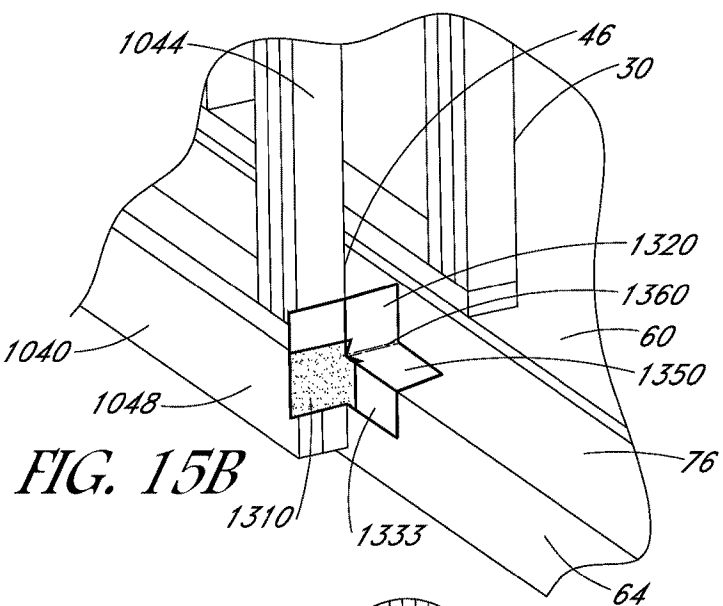
FIGS. 15A-D are close-up views of an embodiment of placing a first outside corner member on the building wall, specifically on the outside frame on the left side of the building wall as shown in FIG. 12.
Figure 15D:
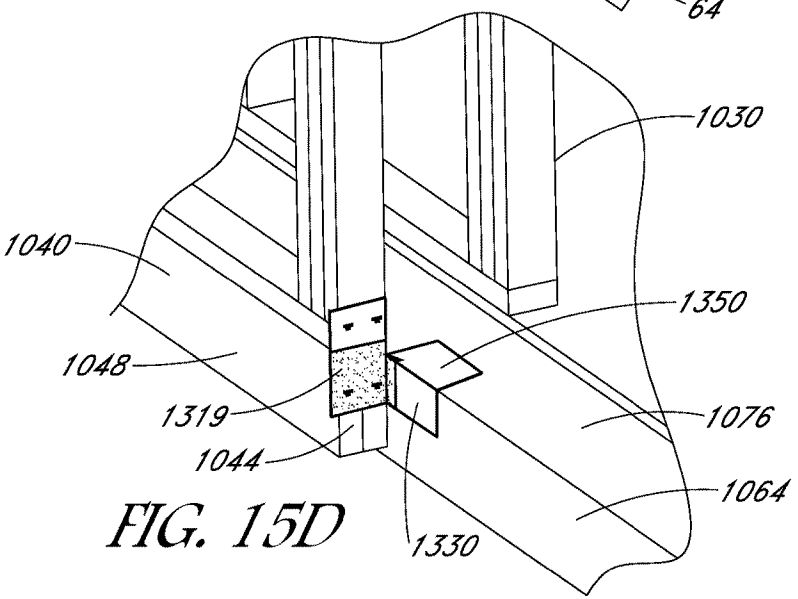
Figure 15A:
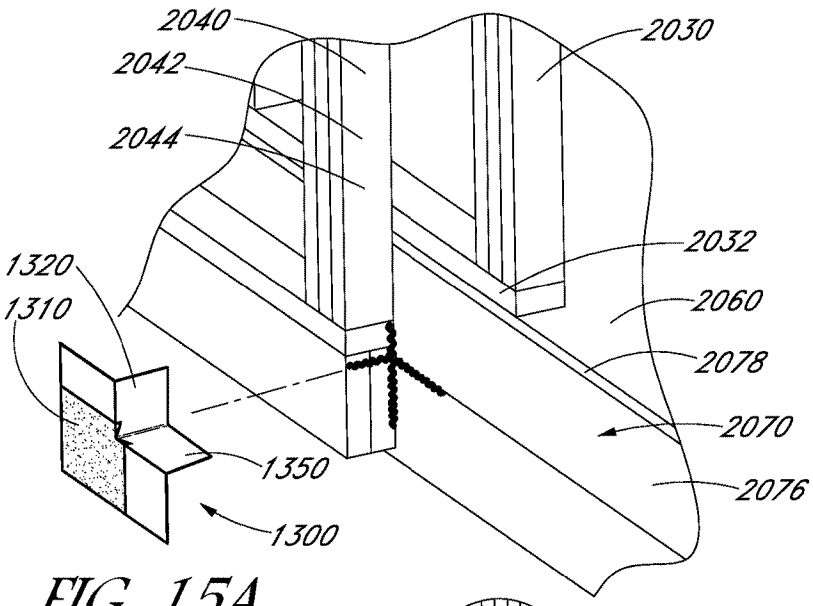

FIGS. 15A-D are close-up views of an embodiment of the placement the first outside corner member 1030 on the first outer frame 1040 and the subfloor 1060. FIG. 15A shows an embodiment of applying sealant 1080 before placing the first outside corner member 1300. In some embodiments, the sealant 1080 is applied in a discontinuous method, for example, separate beads or lines. In some embodiments, a sealant is not applied. In some embodiments, the sealant 1080 may be applied to the first outside corner member 1300.

FIG. 15B shows an embodiment of placing the first outside corner member 1300 on the first outer frame 1040 and the subfloor 1060. The first vertical seating flange 1310 contacts the vertical surface 1044 of the end 1042 of the first outer frame 1040. The first vertical seating flange 1310 may be folded so that the third vertical seating flange 1330 contacts the first vertical surface 1064 of the subfloor 1060. In some embodiments, the first outside corner member 1300 may have a crease indicating where to fold the first vertical seating flange 1310 and defining the third vertical seating flange 1330. In some embodiments, the first outside corner member 1300 does not have a crease indicating where to fold the first vertical seating flange 1310. The horizontal seating flange 1350 of the first outside corner member 1300 contacts the horizontal surface 1076 of the channel 1070 in the subfloor 1060. As shown in FIG. 15B, the second vertical seating flange 1320 may be generally parallel with the first vertical seating flange 1310 and/or the vertical surface 1044 of the end 1042 of the first outer frame 1040. In some embodiments, there may be a crease defining the edge between the second vertical seating flange 1320 and the first vertical seating flange 1310. In some embodiments, there may not be a crease.

Figure 15C:
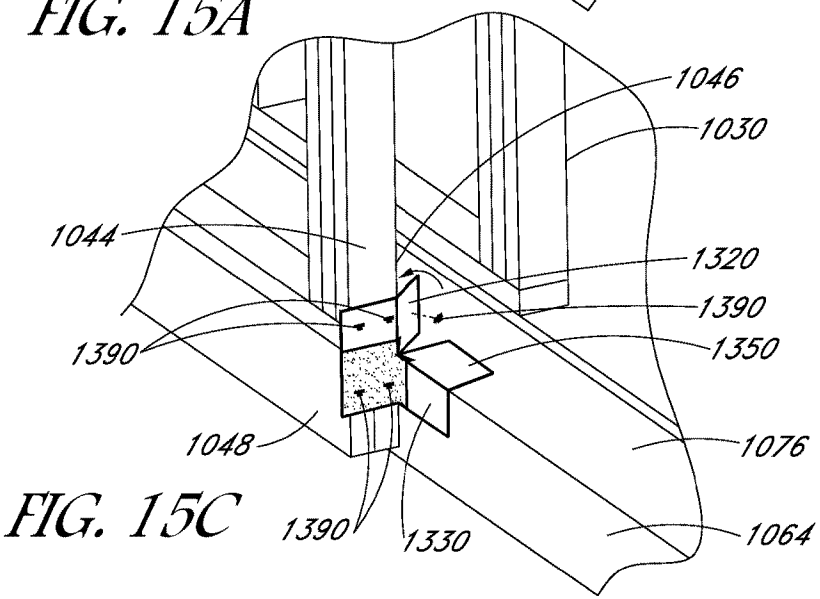
Figure 16B:
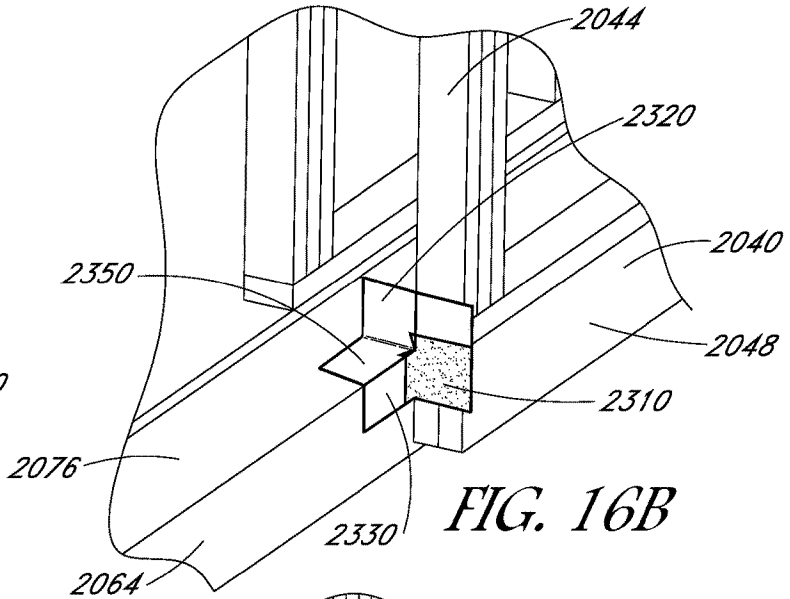
FIGS. 16A-D are close-up views of an embodiment of placing a second outside corner member on the building wall, specifically on the outside frame on the right side of the building wall as shown in FIG. 12.
Figure 16D:
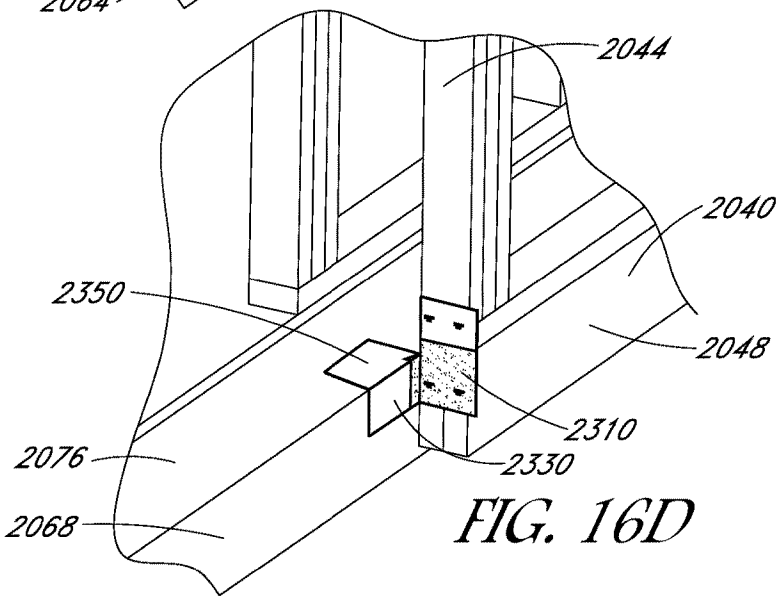

FIGS. 15C-D show an embodiment of wrapping the second vertical seating flange 1320 around the end 1042 of the first outer frame 1040 so that the second vertical seating flange 1320 contacts the first vertical surface 1046 of the first outer frame 1040, which faces the internal space 1050. In some embodiments, the edge 1360 between the horizontal seating flange 1350 and the second vertical seating flange 1320 of the first outside corner member 1300 is cut to allow the second vertical seating flange 1320 to contact the first vertical surface 1046 of the first outer frame 1040, as shown in FIG. 15C. In some embodiments, the first outside corner member 1300 may come pre-cut. In some embodiments, the first outside corner member 1300 is formed such that the horizontal seating flange 1350 and the second vertical seating flange 1320 are not connected so as to not need to be cut.

As shown in FIG. 15C, the first vertical seating flange 1310 of the first outside corner member 1300 may be secured to the end 1042 of the first outer frame 1040 using one or more fasteners 1090, such as staples. The second vertical seating flange 1320 may be secured to the first outer frame 1040 using the one or more fasteners 1090. In some embodiments, the first outside corner member 1300 may be secured using nails, pins, screws, adhesive, or other securing means. The material of the first outside corner member 1300 provides self-sealing around the staples or other means for securing, thus maintaining the weather-tight seal for the door frame. In some embodiments, a securing means is not used.

As shown in FIG. 15D, a portion of the first vertical seating flange 1310 of the first outside corner member 1300 may extend farther than the vertical surface 1044 of the end 1042 of the first outer frame 1040. In some embodiments, this portion of the first vertical seating flange 1310 may be folded to contact the second vertical surface 1048 of the first outer frame 1040, defining a fourth vertical seating flange 1340 of the first outside corner 1300.

Figure 16A:
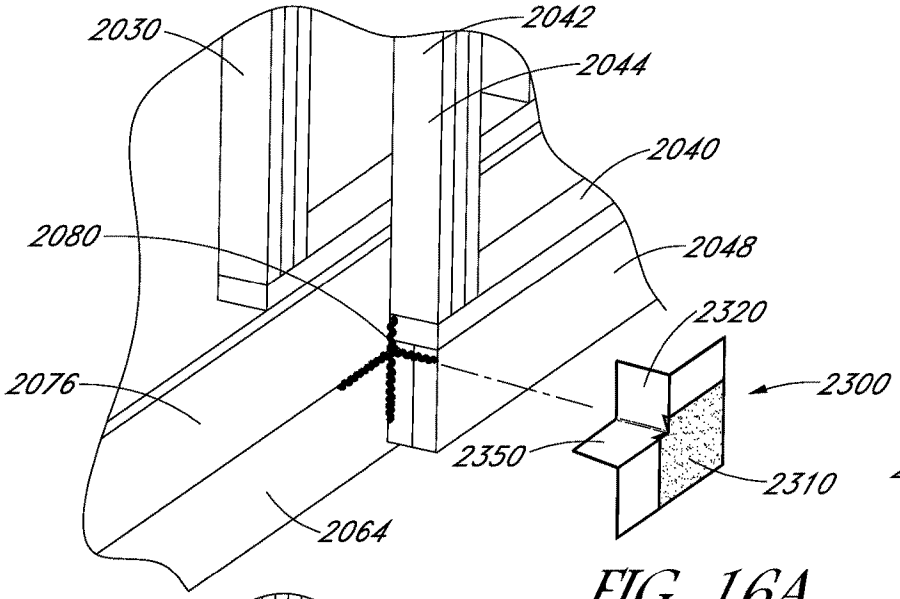
Figure 16C:
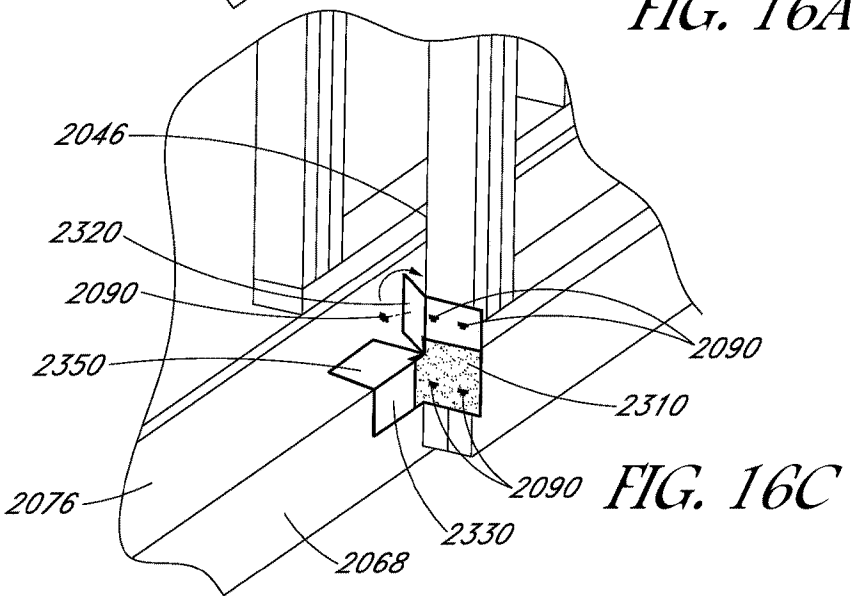

FIGS. 16A-D are close-up views of an embodiment the placement of the second outside corner member 2300 on the second outer frame 2040 and the subfloor 1060. The installation of the second outside corner member 2300 is a mirror image of the installation of the first outside corner member 1300. The second outside corner member 2300 has the same or similar shape to the first outside corner member 1300. The positioning of the second outside corner member 2300 is rotated when compared to the first outside corner member 1300. FIG. 16A shows an embodiment of applying sealant 1080.

FIG. 16B shows an embodiment of placing the second outside corner member 2300 on the second outer frame 2040 and the subfloor 1060. The first vertical seating flange 2310 contacts the vertical surface 2044 of the end 2042 of the second outer frame 2040. The first vertical seating flange 2310 may be folded so that the third vertical seating flange 2330 contacts the first vertical surface 1064 of the subfloor 1060. In some embodiments, the second outside corner member 2300 may have a crease indicating where to fold the first vertical seating flange 2310 and defining the third vertical seating flange 2330. In some embodiments, the second outside corner member 2300 does not have a crease indicating where to fold the first vertical seating flange 2310. The horizontal seating flange 2350 of the second outside corner member 2300 contacts the horizontal surface 1076 of the channel 1070 in the subfloor 1060. As shown in FIG. 16B, the second vertical seating flange 1320 of the second corner member 2300 may be generally parallel with the first vertical seating flange 2310 and/or the vertical surface 2044 of the end 2042 of the second outer frame 2040. In some embodiments, there may be a crease defining the edge between the second vertical seating flange 2320 and the first vertical seating flange 2310 of the second outside corner member 2300. In some embodiments, there may not be a crease.

FIGS. 16C-D show an embodiment of wrapping the second vertical seating flange 2320 around the end 2042 of the second outer frame 2040 so that the second vertical seating flange 2320 contacts the first vertical surface 2046 of the second outer frame 2040, which faces the internal space 2050. In some embodiments, the edge 2360 between the horizontal seating flange 2350 and the second vertical seating flange 2320 of the second outside corner member 2300 is cut to allow the second vertical seating flange 2320 to contact the first vertical surface 2046 of the second outer frame 2040, as shown in FIG. 16C. In some embodiments, the second outside corner member 2300 may come pre-cut. In some embodiments, the second outside corner member 2300 is formed such that the horizontal seating flange 2350 and the second vertical seating flange 2320 are not connected so as to not need to be cut.

As shown in FIG. 16C, the first vertical seating flange 2310 of the second outside corner member 2300 may be secured to the end 2042 of the second outer frame 2040 using one or more fasteners 1090, such as staples. The second vertical seating flange 2320 may be secured to the second outer frame 2040 using one or more staples 1090. In some embodiments, the second outside corner member 2300 may be secured using nails, pins, screws, adhesive, or other securing means. The material of the first outside corner member 2300 provides self-sealing around the staples or other means for securing, thus maintaining the weather seal for the door frame. In some embodiments, a securing means is not used.

As shown in FIG. 16D a portion of the first vertical seating flange 2310 may extend farther than the vertical surface 2044 of the end 2042 of the second outer frame 2040. As shown in FIG. 17C, this portion of the first vertical seating flange 2310 may be folded to contact the second vertical surface 2048 of the second outer frame 2040, defining a fourth vertical seating flange 2340 of the second outside corner 2300.

Figure 17A:
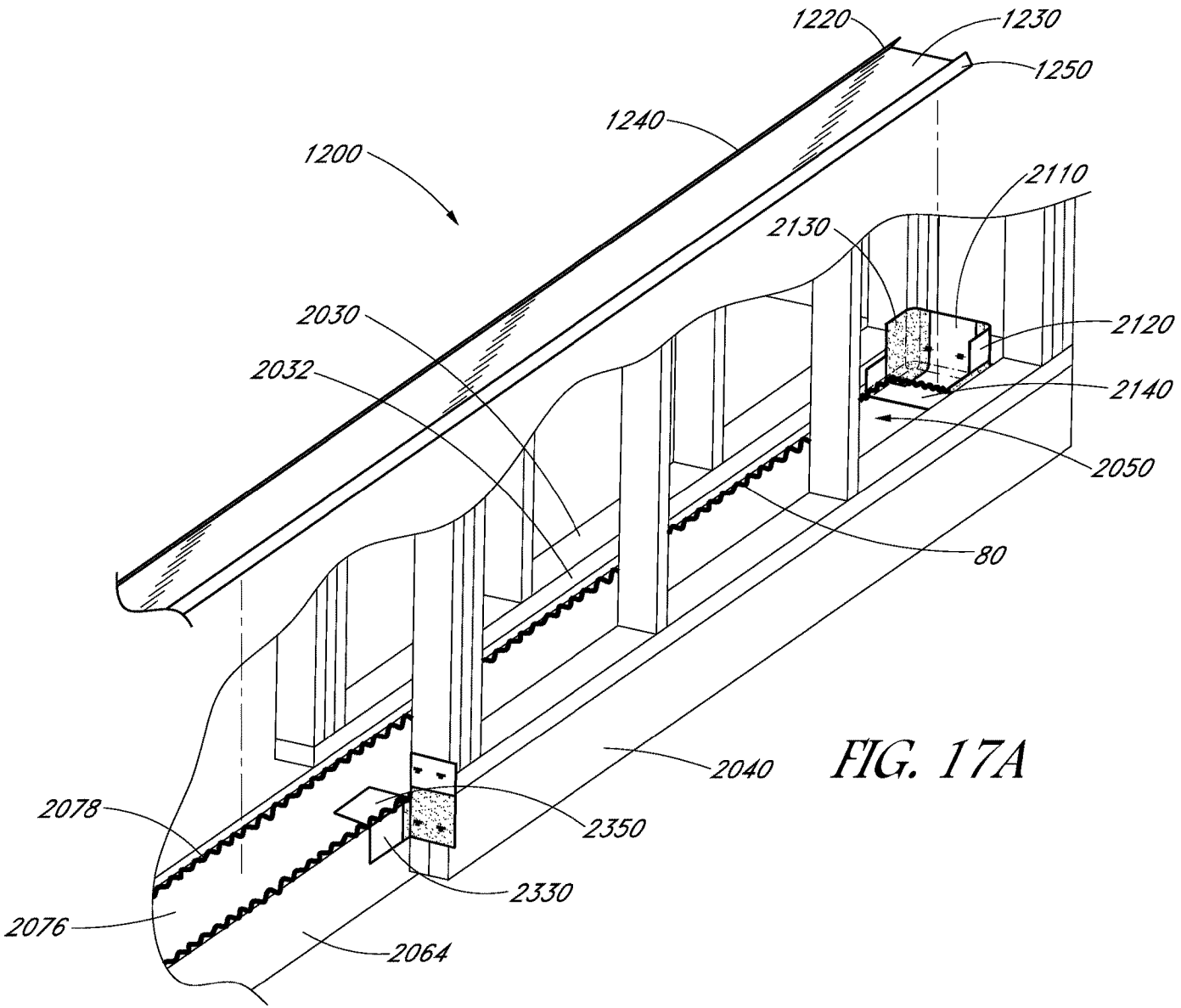
FIGS. 17A-C are close-up views of embodiments of the placement of a right side portion of the insert on the second end dam and along the channel in the building wall shown in FIG. 12.
Figure 17B:
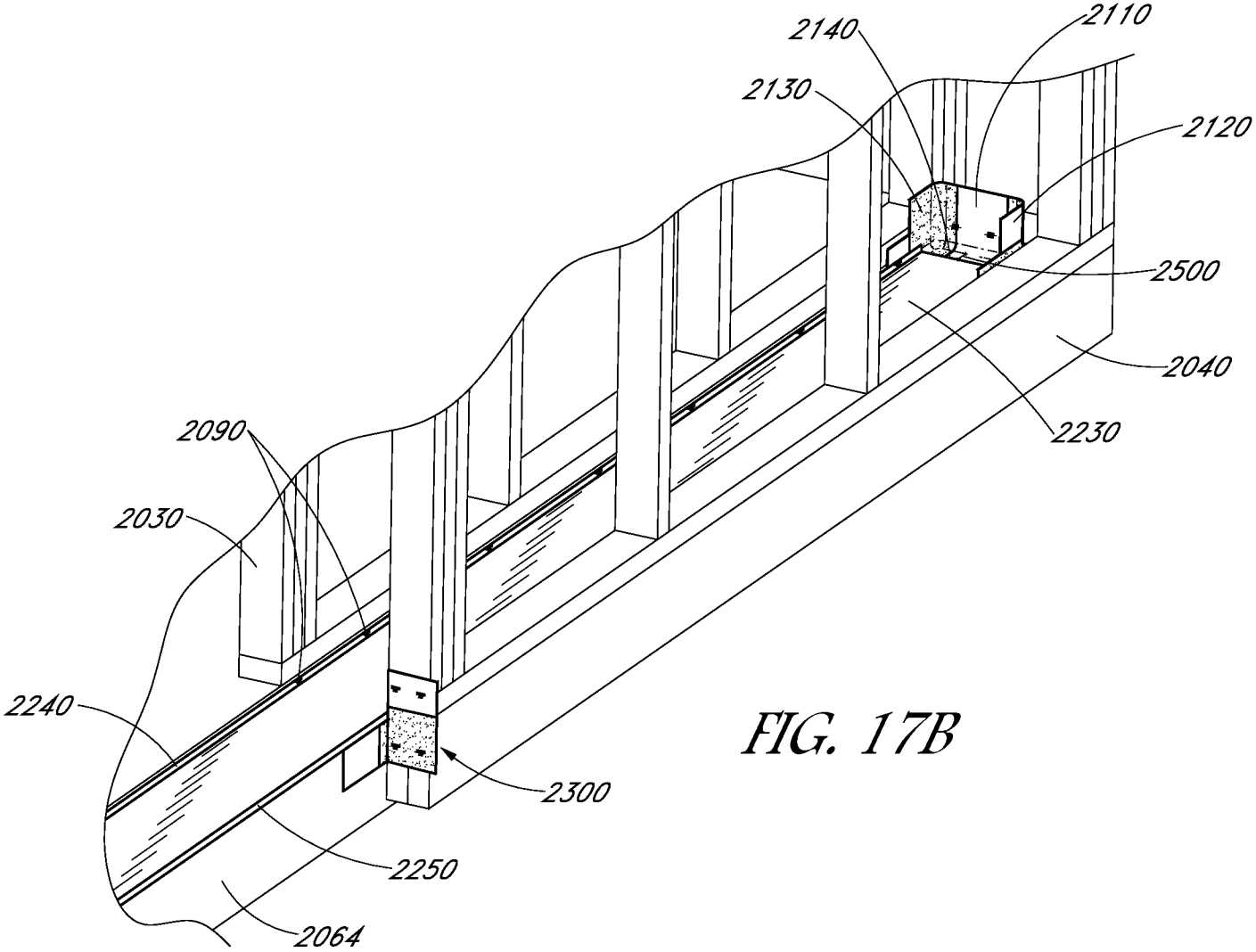
Figure 17C:
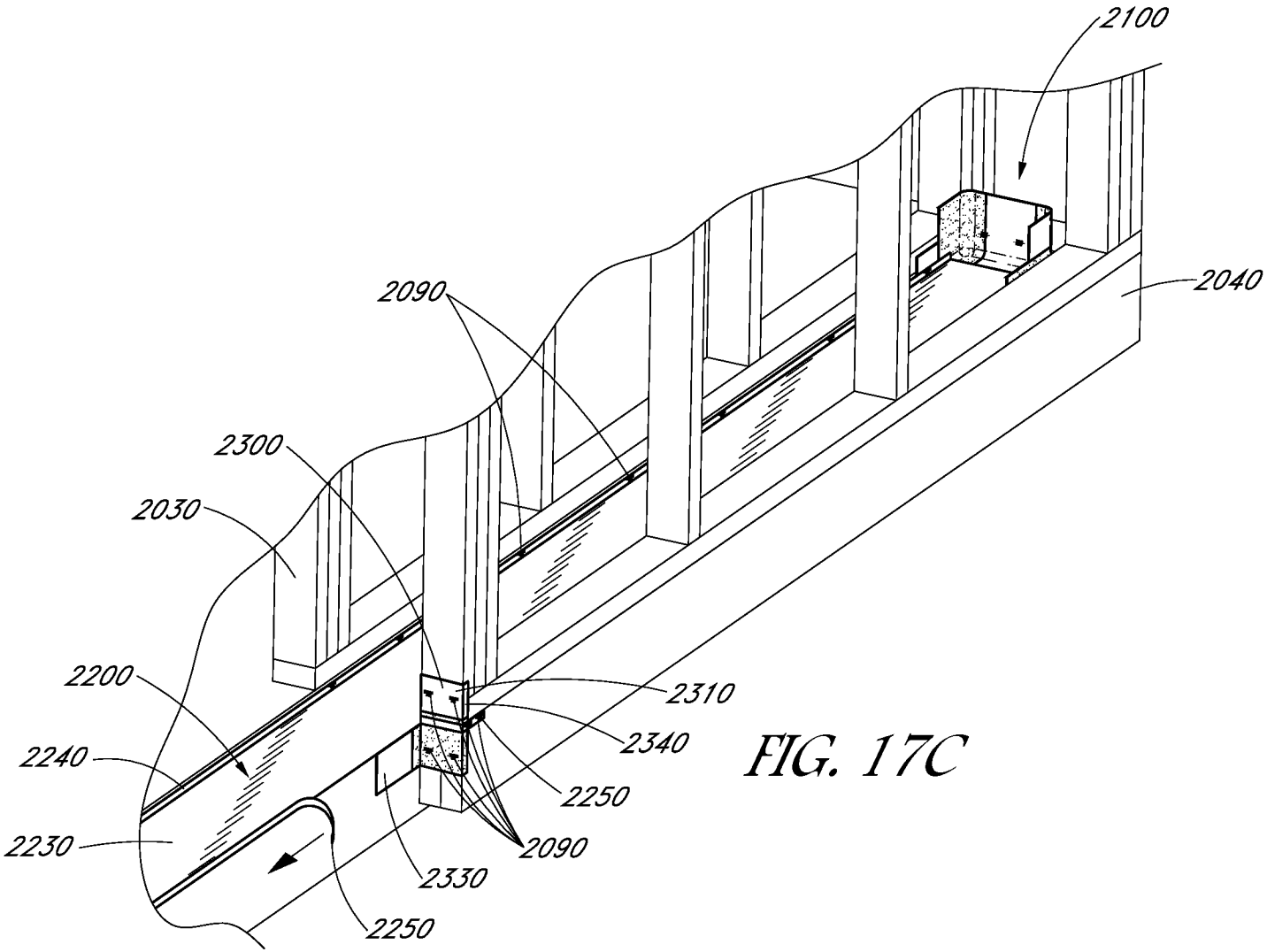

FIGS. 17A-C are close-up views of embodiments of the placement of the insert 1200 along the channel 1070 in the subfloor 1060, specifically in the second internal space 2050. FIG. 17A shows an embodiment of applying sealant 1080 before placing the insert 1200 in the internal space 2050. The sealant 1080 is applied to the second end dam 2100, the second outside corner member 2300, and the channel 1070. In some embodiments, the sealant 1080 is applied in a discontinuous method, for example, separate beads or lines. In some embodiments, a sealant is not applied. In some embodiments, the sealant 1080 may be applied to the insert 1200.

FIG. 17B shows the insert 1200 positioned along the channel 1070, near the second end dam 2100 and the second door stud 2020. In some embodiments, the insert 1200 is trimmed to fit the length of the channel 1070. As shown in FIG. 17B, there may be a gap 1500 between the second end 1210 of the insert 1200 and the first seating flange 2110 of the second end dam 2100. In some embodiments, there may be no gap 1500. The base 1230 of the insert 1200 may partially overlap the base 2140 of the second end dam 2100 or vice versa. In some embodiments, the base 1230 of the insert 1200 completely covers the base 2140 of the second end dam 2100. In some embodiments, the base 1230 of the insert 1200 partially covers the base 2140 of the second end dam 2100 so that a portion of the base 2140 of the second end dam 2100 is exposed. The base 1230 of the insert 1200 contacts the horizontal surface 1076 of the channel 1070 in the subfloor 1060.

As shown in FIG. 17B, a first vertical seating flange 1240 of the insert 1200 contacts a first vertical surface 1078 of the channel 1070. In some embodiments, the first vertical seating flange 1240 of the insert 1200 may extend farther than the first vertical surface 1078 of the channel 1070. In some embodiments, a portion of the first vertical seating flange 1240 of the insert 1200 may contact the first vertical surface 2032 of the second inner frame 2030. In some embodiments, any excess material of the first vertical seating flange 1240 of the insert 1200 may be removed, for example, by cutting it off. The first vertical seating flange 1240 of the insert 1200 may be secured using one or more staples 1090. Other means for securing may be used. For example, in some embodiments, the insert 1200 may be secured using nails, pins, screws, adhesive, or other securing means. The material of the insert 1200 provides self-sealing around the staples or other means for securing, thus maintaining the weather-tight seal for the door frame. In some embodiments, a securing means is not used.

In some embodiments, a portion of a second vertical seating flange 1250 of the insert 1200 contacts the first vertical surface 2046 of the second outer frame 2040. In some embodiments, the portion of the insert 1200 that contacts the first vertical surface 2046 of the second outer frame 2040 is the portion that extends through the second internal space 2050. In some embodiments, a portion of the second vertical seating flange 1250 of the insert 1200 that extends across the threshold is removed, as shown in FIG. 17C. In some embodiments, a portion of the second vertical seating flange 1250 of the insert 1200 is wrapped around the end 2042 of the second outer frame 2040. The second vertical seating flange 1250 of the insert 1200 may contact the first vertical seating flange 2310 of the second outside corner member 2300 and wrap around to contact the second vertical surface 2048 of the second outer frame 2040 and the fourth vertical seating flange 2340 of the second outside corner member 2300. In some embodiments, the portion of the second vertical seating flange 1250 that extends across the threshold is folded down and contacts the first vertical surface 1064 of the subfloor 1060.

The insert 1200 is installed in a similar way through the first internal opening 2050 near the first end dam 1100 and first door stud 1020.

Figure 18:
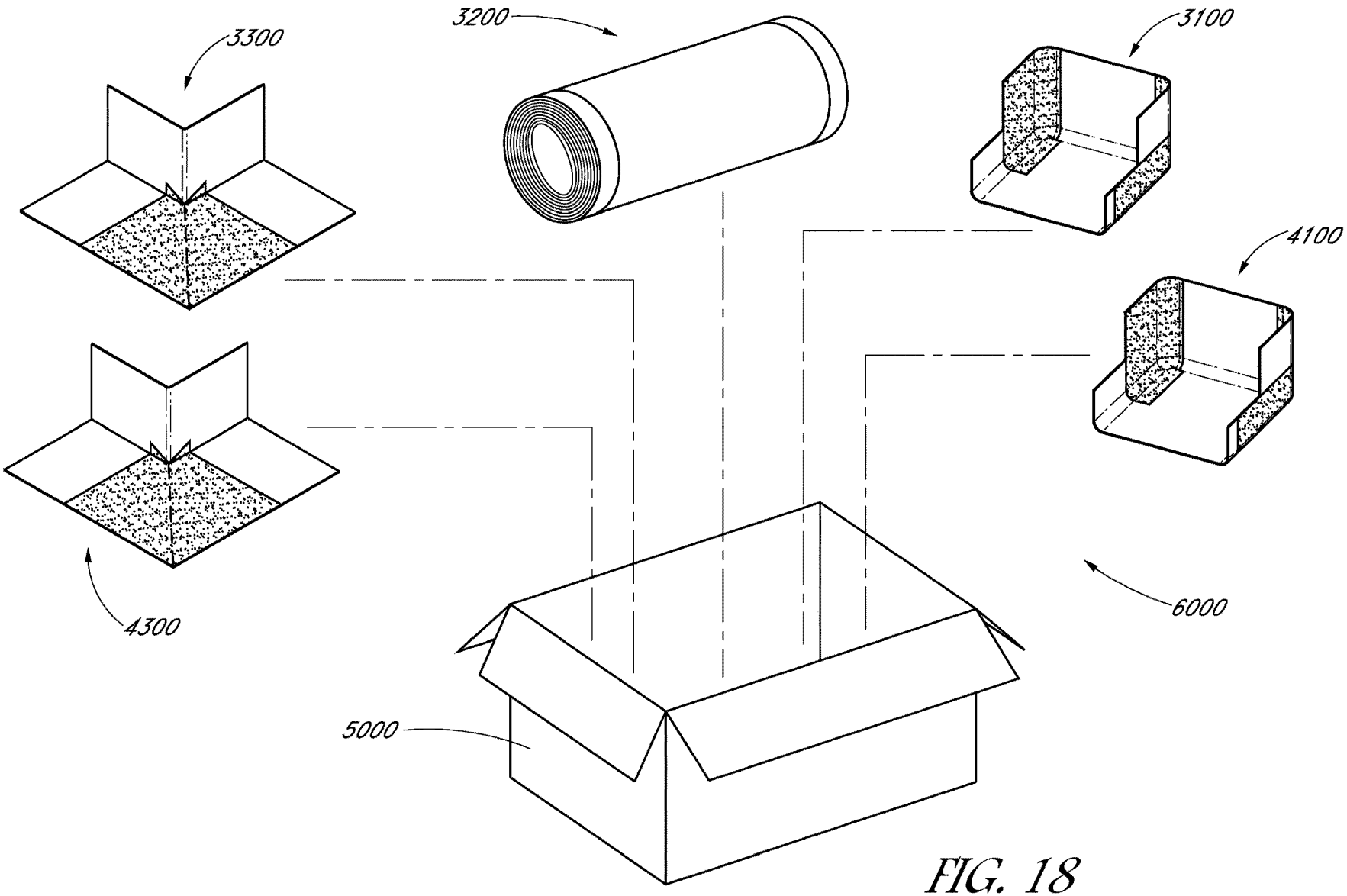
FIG. 18 is a perspective view of an embodiment of a kit for a multi-piece, flexible, sill pan that includes two end dams, one or two outside corner members, and an insert.

FIG. 18 shows an embodiment of a kit 6000 for a sill pan door assembly. As shown in FIG. 18, in some embodiments, the kit 6000 includes two end dams 3100, 4100, an insert 3200, and two outside corner members 3300, 4300. This type of kit may be used for a double-pocket door. The pieces 3100, 4100, 3200, 3300, 4300 may be placed in a container 5000. As shown in FIG. 18, the container 5000 may be a box. In some embodiments, the container 5000 may be a bag, wrap, or other suitable container for containing the flexible pieces 3100, 4100, 3200, 3300, 4300.

The insert 3200 may be rolled or folded since the insert 3200 is constructed from a flexible material, making it more convenient and/or saving spacing when packing the insert 3200 in the container 5000. The outside corner members 3300, 4300 may be folded since they are constructed from a flexible material, making it more convenient and/or saving spacing when packing the outside corner members 3300, 4300 in the container 5000.

In some embodiments, the kit 6000 may includes two end dams 3100, 4100, an insert 3200, and one outside corner member 3300. This type of kit may be used for a single-pocket door. In some embodiments, the kit 6000 may include an end dam that is shaped similar to end dam 400 as shown in FIG. 11B, where the end dam 400 is formed such that the base 440 and the third vertical seating flange 430 are not connected.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The above description discloses several methods and materials of the present invention. This invention is susceptible to modifications in the methods and materials, as well as alterations in the fabrication methods and equipment and in the installation methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A kit for a flexible, sill pan that is configured to be installed in a framed wall condition in a building wall that is configured to receive a pocket door for a doorway, the framed wall condition including an inner frame, an outer frame, and a first door stud together defining an internal space for receiving the pocket door, a bottom of the internal space being formed by a channel in a subfloor, the channel in the subfloor extending from the first door stud to a second door stud disposed on an opposite side of the doorway, the kit comprising:

a first flexible end dam member that is configured to be secured between the inner and outer frames, and against the first door stud such that a first vertical seating flange of the first flexible end dam member contacts a generally vertical surface of the first door stud, a second vertical seating flange of the first flexible end dam member contacts a generally vertical surface of the inner frame, a third vertical seating flange of the first flexible end dam member contacts a generally vertical surface of the outer frame, and a generally horizontal base of the first flexible end dam member contacts a generally horizontal surface of the subfloor in the channel;

a second flexible end dam member that is configured to be secured against the second door stud such that a first vertical seating flange of the second flexible end dam member contacts a generally vertical surface of the second door stud, a second vertical seating flange of the second flexible end dam member contacts a generally vertical surface of the subfloor in the channel, and a generally horizontal base of the second flexible end dam member contacts a generally horizontal surface of the subfloor in the channel;

a flexible outside corner member that is configured to be secured to the outer frame and the subfloor such that a first vertical seating flange of the flexible outside corner member contacts a generally vertical surface of an end of the outer frame, a second vertical seating flange of the flexible outside corner member contacts a generally vertical surface of the outer frame, a third generally vertical seating flange of the flexible outside corner member contacts a generally vertical surface of the subfloor outside the channel, and a generally horizontal seating flange of the flexible outside corner member contacts a generally horizontal surface of the subfloor in the channel; and a flexible insert that is configured to be secured in the channel in the subfloor and between the first and second flexible end dams such that a base of the flexible insert contacts a generally horizontal surface of the subfloor in the channel and overlaps the horizontal seating flange of the flexible outside corner member, a first end of the flexible insert overlaps at least a portion of the horizontal seating flange of the first flexible end dam member, a second end of the flexible insert overlaps at least a portion of the horizontal seating flange of the second flexible end dam member, and a generally vertical seating flange of the flexible insert contacts a generally vertical surface of the subfloor in the channel.

2. The kit of claim 1, wherein a thicknesses of a material used to construct the first flexible end dam, the second flexible end dam, the outside corner member, and the flexible insert is between 20 mil and 30 mil.

3. The kit of claim 1, wherein a material used to construct the first flexible end dam, the second flexible end dam, the outside corner member, and the flexible insert is an asphalt- or petroleum-based flashing material.

4. The kit of claim 1, wherein a material used to construct the first flexible end dam, the second flexible end dam, the outside corner member, and the flexible insert is a butyl-based flashing material.

5. The kit of claim 1, wherein at least one of the first flexible end dam member and the second flexible end dam member is integral with the flexible insert.

6. The kit of claim 1, wherein the flexible outside corner member is integral with the flexible insert.

7. The kit of claim 1, wherein the first flexible end dam member comprises a first piece of adhesive-backed flexible flashing material, a second piece of adhesive-backed flexible flashing material, and an end dam, and wherein the first piece of adhesive-backed flexible flashing material and the second piece of adhesive-backed flexible flashing material laminates the end dam.

8. A kit for a flexible, sill pan that is configured to be installed in a framed wall condition in a building wall that is configured to receive a pocket door for a doorway, the framed wall condition including an inner frame, an outer frame, and a first door stud together defining an internal space for receiving the pocket door, a bottom of the internal space being formed by a channel in a subfloor, the channel in the subfloor extending from the first door stud to a second door stud disposed on an opposite side of the doorway, the kit comprising:

a first end dam member that is configured to be secured between the inner and outer frames, and against the first door stud such that a first seating flange of the first end dam member contacts a surface of the first door stud, a second seating flange of the first end dam member contacts a surface of the inner frame, a third seating flange of the first end dam member contacts a surface of the outer frame, and a base of the first end dam member contacts a surface of the subfloor in the channel;

a second end dam member that is configured to be secured against the second door stud such that a first seating flange of the second end dam member contacts a surface of the second door stud, a second seating flange of the second end dam member contacts the surface of the subfloor in the channel, and a base of the second end dam member contacts the surface of the subfloor in the channel; and an insert that is configured to be installed in the channel in the subfloor and between the first and second end dams such that a base of the insert contacts the surface of the subfloor in the channel, a first end of the insert overlaps at least a portion of the seating flange of the first end dam member, a second end of the insert overlaps at least a portion of the seating flange of the second end dam member, and a seating flange of the insert contacts the surface of the subfloor in the channel.

9. The kit of claim 8, further comprising an outside corner member that is configured to be secured to the outer frame and the subfloor such that a first seating flange of the outside corner member contacts a surface of an end of the outer frame, a second seating flange of the outside corner member contacts a surface of the outer frame, a third seating flange of the outside corner member contacts a surface of the subfloor outside the channel, and a fourth seating flange of the outside corner member contacts the surface of the subfloor in the channel.

10. The kit of claim 9, wherein the base of the insert is configured to overlap the fourth seating flange of the outside corner member.

11. The kit of claim 8, wherein a thicknesses of a material used to construct the first end dam, the second end dam, the outside corner member, and the insert is between 20 mil and 30 mil.

12. The kit of claim 8, wherein a material used to construct the first end dam, the second end dam, the outside corner member, and the insert is an asphalt- or petroleum-based flashing material.

13. The kit of claim 8, wherein a material used to construct the first end dam, the second end dam, the outside corner member, and the insert is a butyl-based flashing material.

14. The kit of claim 8, wherein at least one of the first end dam member and the second end dam member is integral with the insert.

15. The kit of claim 8, wherein the outside corner member is integral with the insert.

16. A kit for a flexible, sill pan that is configured to be installed in a framed wall condition in a building wall, the framed wall condition including an inner frame, an outer frame, and a first door stud together defining an internal space, a bottom of the internal space being formed by a channel in a subfloor, the channel in the subfloor extending from the first door stud to a second door stud, the kit comprising:

a first end dam member that is configured to be secured between the inner and outer frames, and supported by the first door stud such that a first seating flange of the first end dam member is supported by a surface of the first door stud, a second seating flange of the first end dam member is supported by a surface of the inner frame, a third seating flange of the first end dam member is supported by a surface of the outer frame, and a base of the first end dam member is supported by a surface of the subfloor in the channel;

a second end dam member that is configured to be supported by the second door stud such that a first seating flange of the second end dam member is supported by a surface of the second door stud, a second seating flange of the second end dam member is supported by the surface of the subfloor in the channel, and a base of the second end dam member is supported by the surface of the subfloor in the channel; and an insert that is configured to be installed in the channel in the subfloor and between the first and second end dams such that a base of the insert is supported by the surface of the subfloor in the channel, a first end of the insert overlaps at least a portion of the seating flange of the first end dam member, a second end of the insert overlaps at least a portion of the seating flange of the second end dam member, and a seating flange of the insert is supported by the surface of the subfloor in the channel.

17. The kit of claim 16, further comprising an outside corner member that is configured to be secured to the outer frame and the subfloor such that a first seating flange of the outside corner member is supported by a surface of an end of the outer frame, a second seating flange of the outside corner member is supported by a surface of the outer frame, a third seating flange of the outside corner member is supported by a surface of the subfloor outside the channel, and a fourth seating flange of the outside corner member is supported by the surface of the subfloor in the channel.

18. The kit of claim 17, wherein the base of the insert is configured to overlap the fourth seating flange of the outside corner member.

19. The kit of claim 16, wherein a thicknesses of a material used to construct the first end dam, the second end dam, the outside corner member, and the insert is between 20 mil and 30 mil.

20. The kit of claim 16, wherein at least one of the first end dam member and the second end dam member is integral with the insert.

* * * * *